US006131354A

United States Patent [19]

Thompson

[11] Patent Number: 6,131,354

[45] Date of Patent: Oct. 17, 2000

[54] HURRICANE PROTECTION FOR LARGE WINDOWS AND DOORS

[76] Inventor: Thomas Thompson, 92-543 Kokole Pl., Makakilo, Hi. 96707

[21] Appl. No.: 09/032,560

[22] Filed: Feb. 27, 1998

Related U.S. Application Data

[60] Provisional application No. 60/038,338, Feb. 27, 1997.

[51] Int. Cl.[7] ..... E04B 1/38

[52] U.S. Cl. ..... 52/511; 52/509; 52/202; 49/67; 49/63; 248/300; 248/208; 403/353; 403/354; 403/348

[58] Field of Search ..... 52/511, 509, 202, 52/489.1, 713; 403/353, 354, 348; 248/300, 208; 49/67, 63

[56] References Cited

U.S. PATENT DOCUMENTS

| | | | |
|---|---|---|---|
| 1,219,685 | 5/1917 | Wall | 248/300 |
| 1,628,249 | 5/1927 | Kirfman | 52/202 |
| 1,666,896 | 4/1928 | Habenicht | 248/300 |
| 1,718,878 | 6/1929 | Raquette | 248/300 |
| 2,708,088 | 5/1955 | Steinke | 248/300 |
| 3,071,400 | 1/1963 | Bellock | 403/353 |
| 3,156,282 | 11/1964 | Bedford, Jr. | 403/353 |
| 3,944,809 | 3/1976 | Moore et al. | 248/300 |
| 4,248,022 | 2/1981 | Walker . | |
| 4,333,271 | 6/1982 | De Paolo . | |
| 4,384,436 | 5/1983 | Green . | |
| 4,473,316 | 9/1984 | Welch | 403/353 |
| 5,228,238 | 7/1993 | Fenkell . | |
| 5,335,452 | 8/1994 | Taylor . | |
| 5,345,716 | 9/1994 | Caplan . | |
| 5,347,775 | 9/1994 | Santos . | |
| 5,383,315 | 1/1995 | Birs . | |
| 5,469,905 | 11/1995 | McKinney . | |
| 5,540,018 | 7/1996 | Biggers . | |
| 5,737,874 | 4/1998 | Sipos . | |

FOREIGN PATENT DOCUMENTS

| | | | |
|---|---|---|---|
| 623855 | 5/1949 | United Kingdom | 248/300 |

*Primary Examiner*—Carl D. Friedman
*Assistant Examiner*—Dennis L. Dorsey

[57] ABSTRACT

Hurricane shutter hardware for patio doors, picture windows, and other large openings on a house. The hardware consists of mounts that are permanently attached to a house, and brackets that are mounted to a shutter cover. The mounts are composed of unique metal bends that are configured to fit on a wide variety of homes and lock onto the brackets which are attached to shutters. The brackets have distinctive shapes which allow almost any type of material to be used as a shutter cover. The mount and bracket are quickly and easily locked together after a hurricane warning, covering a window with a shutter.

15 Claims, 39 Drawing Sheets

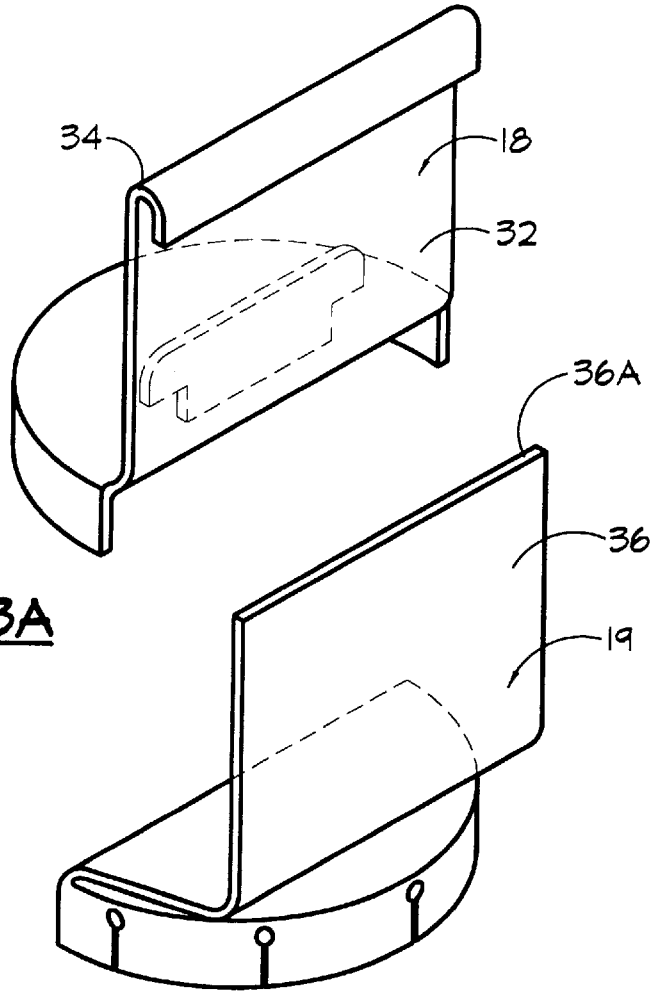
FIG. 23A
FIG. 24A
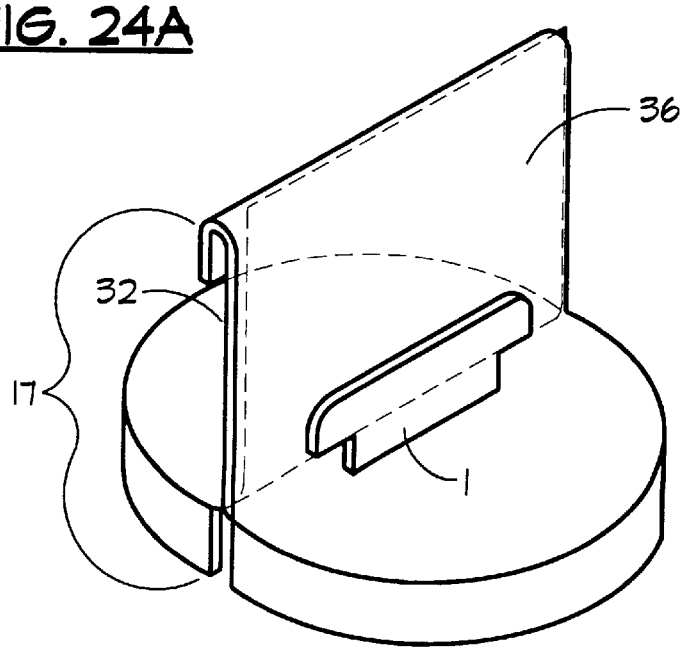
FIG. 24B

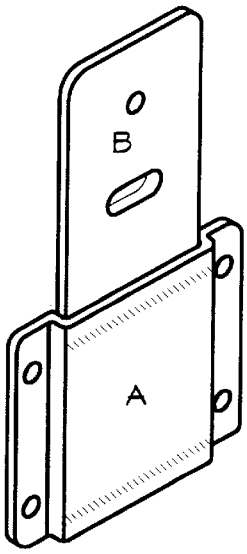
FIG. 44A
FIG. 44B
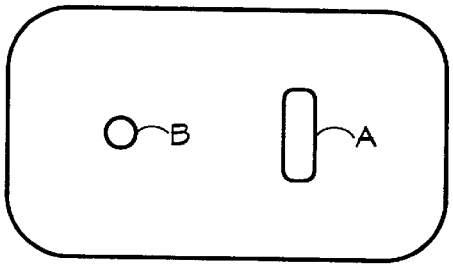
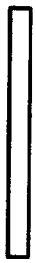
FIG. 44C
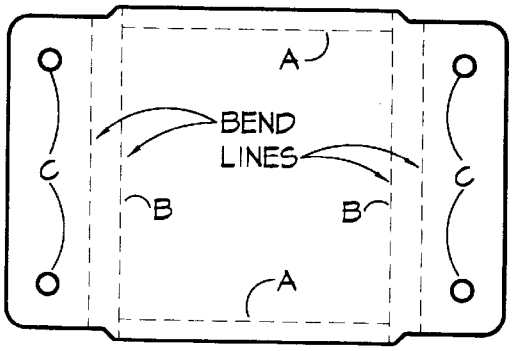
FIG. 44D
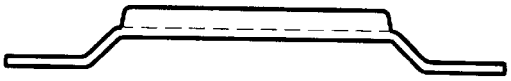
FIG. 44E
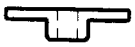
FIG. 44F

HURRICANE PROTECTION FOR LARGE WINDOWS AND DOORS

The Provisional Patent Application for this patent application Ser. No. 60/038,338 filed on Feb. 27, 1997.

BACKGROUND

1. Field of Invention

The invention relates to prior application Ser. No. 08/597,194, and consists of a shutter, fastener, and locking mechanism that provides an easy to install means of protecting large door and window openings from hurricanes, strong winds, rain, wind-blown debris, and vandals.

2. Description of Prior Art

BACKGROUND

Studies of damage from Hurricanes Hugo, Andrew, and Iniki show that most of the damage to a home was from the wind or wind-borne missiles that broke a window and let rain and wind into the home. Once the wind was inside a home, the resulting pressure helped lift the roof off the house. Shutters can help keep the wind and rain from entering a home during strong winds.

During Hurricane warnings, plywood is usually nailed over windows and patio doors to prevent wind-driven rain and debris from breaking the window and entering the house. Nailing sheets of plywood over windows is difficult on many homes, and it could take too much time to secure a cover over each window. Strong winds can rip down nailed-up plywood; and roll-down shutters and louvered shutters are also ineffective (Fine Homebuilding, 1992).

Homeowners are usually reluctant to drive nails into their window frames or do not want to be on a ladder during high winds. An individual can not hold up a large, heavy piece of plywood and nail it in at the same time. When a hurricane is expected, often the building suppliers run out of plywood.

Plywood nailed to a window frame can be blown out of a building due to the high pressure inside a building compared to the low pressure outside during high winds. This is due to the Bernoulli effects, where wind blowing around and over a building causes lower pressure than the high pressure air inside, and sucks out a window, wall, or roof.

LIST OF REFERENCES FROM THE SPECIFICATION

Several recent types of shutter systems have been patented including U.S. Pat. No. 4,248,022 (1981) to Walker, U.S. Pat. No. 4,333,271 (1982) to De Paolo et al, U.S. Pat. No. 4,384,436 (1983) to Green, U.S. Pat. No. 5,228,238 (1993) to Fenkell, U.S. Pat. No. 5,335,452 (1994) to Taylor, U.S. Pat. No. 5,345,716 (1994) to Caplan, U.S. Pat. No. 5,347,775 (1994) to Santos, and U.S. Pat. No. 5,383,315 (1995) to Birs.

Previous patent application Ser. No. 08/191,852. A retrofit hurricane clip.

Previous patent application Ser. No. 08/597,194. A shutter system for windows.

(Miller, 1992)

(Civil Engineering, 1994)

(Home Mechanix, 1995)

(Fine Homebuilding, 1992)

An airplane rises due to the pressure differential of faster air moving over a wing, compared to the high pressure of slower moving air under a wing. So too does the side walls blow out of a house due to the Bernoulli effects of wind blowing perpendicular to the wall. Gable ends blow out of a house, because of higher pressure in the house compared to the extremely low pressure on the leeward edge of the wind direction.

Once the window, side wall, or gable end of a house is blown out, the rigidity of the roof and entire house is compromised due to wind getting into the house. Driven rain, along with the wind can damage everything in the house, along with damaging the structural integrity of the roof and walls of the house.

Previously, homeowners thought that they could prevent their walls from being blown out by opening windows to relieve the high pressure on the leeward and sides of a house, but the open windows on the windward side let in wind and rain. If windows are open on the leeward side only, the wind can rapidly change direction and blow into the windows. The wind must go somewhere, and would blow out the walls or roof as it sought a way out. The resulting damage negates any advantage of trying to ease the pressure differential.

This invention is simple to install, economical, and can fit on a wide variety of houses.

The current fad of testing shutters is by shooting a 2×4 into the shutter to test its strength. This simulates a roof rafter being blown into the shutter from a neighbor's house. My previous patent application Ser. No. 08/191,852 helps keep the rafter and roof on a house, and would prevent many of these missiles.

The factual odds of a 2×4 being blown head-on into a window shutter is minuscule. Actually, a 2×4 fired headed-on into a building would go through most wood-frame and concrete-block walls. Studies after Hurricane Andrew show that the most common projectile was roof shingles and roof tiles; and when roof tiles go airborne, they damage neighboring buildings (Miller, 1992).

One advantage of this invention is that any type of covering can be used for the shutter. Plywood was used in the past because it was readily available, strong, inexpensive, easy to store, and could be cut to fit windows by most homeowners using simple tools. The major problem was with the installation.

No one wanted to be on a ladder during windy conditions, especially trying to hold the heavy plywood sheet with one hand and trying to hammer a nail with the other. That leaves no hands to hold the nail or hold on to the ladder—an unsafe situation.

Plywood can still be used as the shutter material for this invention, but steel and other stronger, lighter, and cheaper materials can be used including new materials as they become available. Researchers testing shutter material claim that thin steel walls are more effective at stopping hurricane debris than thick wood, and the most effective material was 22-gauge steel backed with a thin layer of rubber (Civil Engineering, 1994).

This is good information, but thin sheets of steel with rubber are not readily available to a homeowner. Nevertheless, if it was obtainable, it could be used as the shutter material for this invention.

When thin sheets of steel are corrugated, pleated, or formed into parallel ridges, the resulting shutter cover is stronger than flat steel. Bending the sheets of steel work-hardens it and strengthens the bends. Corrugated metal sheets, used as a shutter cover, are stronger than steel with rubber, and could withstand larger and faster wind-blown missiles. Standard corrugated steel sheets may be used with this invention as a shutter cover, but this invention includes a unique corrugated metal shutter.

Other materials can also be used for the cover such as sheets of aluminum, which are light, recyclable, strong, non-rusting, and relatively easy to cut with power equipment. Kevlar©, fiberglass, rubber sheets, or any strong, lightweight material could also be used for the cover.

Bamboo has recently been used as flooring because it is attractive, wears well, and can be sanded and refinished. Bamboo can be weaved, is flexible and can bend, and can have resins added to make a product as strong as fiberglass. Unlike timber, bamboo is a plentiful grass that regenerates itself quickly from existing root systems after being cut. Bamboo forests are not clear-cut, but are maintained by harvesting mature stalks which makes room for new shoots to grow (Home Mechanix, 1995). In the tropics, bamboo would make a good cover for a shutter and would be environmentally attractive.

Shutters should be bolted to a building (Fine Homebuilding, 1992). During Hurricane Andrew, ¾-in. plywood bolted over a window sustained several hits from tree limbs, but nothing came through (Fine Homebuilding, 1992). Even with modern weather forecasting, there would not be enough time to bolt plywood to each window of a house. This invention has brackets permanently attached to the framing members of a house for quick and easy positioning of a shutter with companion hardware.

CONCRETE-BLOCK HOUSES

In Florida, most of the homes are made of concrete-block walls. The window and patio frames are not set flush with the outside wall, but are set part-way into the thick walls. Many of the window frames and patio doors are made of aluminum alloy and may not be secured correctly to the concrete-block.

To fit into the window opening, a sheet of plywood would have to be cut very accurately. Plywood boards stored for use during a hurricane could warp in the humid climate that is prevalent in Florida, and would not fit into the window opening without alterations.

Sometimes there is only a thin part of the window frame exposed in the window well opening. It is very difficult to nail or screw a sheet of plywood into the narrow exposed part of the window frame. Caulking may be set next to the window well and window frame, and there may be voids next to some window frames. Nails in caulk or voids would not form a secure fastening for the plywood board.

In a concrete-block wall, the window frame is not a structural member of the wall and does not provide any load of the roof, hence it is not very strong. This invention does not attach to the weak window frame of a concrete-block home, but instead attaches to the wall itself. Since the wall has about equal strength around the window, this invention can be mounted on the sides and bottom of the window.

By being attached to the concrete block outside the window well, the plywood sheet does not have to be cut accurately. Even if the board warped, it would still fit over the window well opening and keep out wind and rain. Only small brackets are permanently attached to the cinder block wall and they can be painted to match the wall.

WOOD-FRAME BUILDINGS

In many areas along the East and Gulf Coasts, outside of Florida, and in Hawaii, many of the homes are built of wood. There are two major types of wood-frame houses: platform or stud wall construction, and post-and-beam construction.

In platform framing, the wall sections consist of studs that support the roof or second floor. Wood framing around a window or door opening consists of headers and trimmers which are usually double (or more) the thickness of the wall framing. This extra framing helps provide structural rigidity to the wall, where the wall studs are missing from the window or door area.

On wood-framed houses, the window is sometimes flush with the outside sheathing, but may extend out beyond the sheathing and be framed with wood trim. The header board above the window provides a strong attaching point to affix the hinge plate of this invention. Doors would have similar construction framing and a patio door (sliding-glass) and garage door would have stronger headers and trimmers.

In Hawaii and the Caribbean, many of the homes are built using post-and-beam construction. One of the chief structural advantages of this type of construction is the simplicity of framing around door and window openings.

Since the roof loads are carried by fewer, but stronger timbers, large openings can be framed without the need for headers. Wide window walls are formed by merely inserting window frames between the posts and beams.

Some windows are fixed or non-opening windows which provide daylight and a view of the outdoors. Jalousie windows are also common in tropical areas because they provide excellent ventilation. Both windows are weak against wind and rain, and must be protected by shutters during high winds.

Some houses in Hawaii and the Caribbean have jalousie wood louvers under large non-opening windows that provide ventilation. Shutters are also needed on these louvers to protect them from strong winds, and prevent wind and rain from entering the house.

On post-and-beam houses, the window frame is commonly extended out beyond the outside sheathing and framed with wood trim pieces. The beam above the window provides a strong anchor point for the locks of this invention. The bottom and side frame of the window, which attaches to the posts, forms a strong attaching point for the latching mechanism.

DESCRIPTION OF PRIOR ART

A number of shutter systems are presently marketed to homeowners that are permanently attached to the house. Some of these shutters roll down over a window from an attached compartment, and some are screwed in. Many homeowners dislike prior shutters for many reasons, but mostly because they are complicated, heavy, unreliable, expensive, take a lot of time to deploy, take tools to deploy, or do not match the color and architecture of the house.

Several recent types of shutter systems have been patented including U.S. Pat. No. 4,248,022 (1981) to Walker, U.S. Pat. No. 4,333,271 (1982) to De Paolo et al, U.S. Pat. No. 4,384,436 (1983) to Green, U.S. Pat. No. 5,228,238 (1993) to Fenkell, U.S. Pat. No. 5,335,452 (1994) to Taylor, U.S. Pat. No. 5,345,716 (1994) to Caplan, U.S. Pat. No. 5,347,775 (1994) to Santos, and U.S. Pat. No. 5,383,315 (1995) to Birs.

All are good inventions, but they are not inexpensive, they are not simple, they contain complex hardware, they cannot be installed quickly, they cannot fit wood, concrete-block, and masonry houses, they cannot be installed on the top, bottom, or side of a window, they cannot use different types and thicknesses of material for the shutter, they cannot be installed on the inside of a house, some are too thick to be stored easily, and the hardware is bulky and unattractive on a house.

OBJECTS AND ADVANTAGES

Objects of this invention are to easily, quickly, and economically protect windows, doors, and houses from the destructive winds of hurricanes. It is a further object of this invention that the shutters will not be permanently attached to the house, except for modest plates.

Another objective is to make the installation procedure simple, so that a handy homeowner can install the shutter hardware. A further object is that this invention can be used on various size window and door openings, and various types of houses. Another objective is the shutter can be made out of any material including plywood, steel, corrugated steel, aluminum, bamboo, kevlar©, fiberglass, rubber sheets, or any strong, lightweight material.

A still further object is for the invention to be retro-fit onto new and old homes made of wood, concrete-block, or masonry. Another object is for the shutters to be installed on patio doors, such as in multi-story apartment houses, where they cannot be reached from the outside.

Another object is to retain the shutter cover over the window and door to prevent vandalism after a hurricane has passed. Further objects and advantages of my invention will become apparent from a consideration of the drawings and ensuing description.

These and other objectives of the invention are achieved by a system of simple and economical connectors that allow a homeowner to quickly and easily protect a window or door with a strong covering.

This invention includes several embodiments in order to fit on wood, concrete-block, and masonry houses. Some embodiments are specialized for the type of house; some can be installed in a vertical or horizontal position and some can be installed above, below, or to one side of the window. Several embodiments also use different manufacturing techniques including manipulated sheet metal, casting, forging, extrusion, and plastic molds or injection. Advantages of each will be discussed in the description.

BRIEF DESCRIPTION OF THE DRAWINGS

FIG. 32A shows a perspective view of a party floor mount held down securely to a structure by a bracket.

FIGS. 42A–D show how bending the wing tabs in different directions forms a twist mount that can be mounted 90° in different directions using twist docks.

FIGS. 44-45 show how the flat pattern layout looks before cutting and bending and after cutting and bending.

FIG. 48 shows a single mid-span floor latch.

FIG. 49 shows a shutter cover locking from inside a home.

FIG. 50 shows shutters locked together.

FIG. 51 shows shutter panels secured with pipe.

REFERENCE NUMERALS IN DRAWINGS

| | | | |
|---|---|---|---|
| 1 | Bayonet | 56A | Rear tab bend |
| 2 | Radiused bends | 57 | Pipe |
| 3 | Top side | 58 | Pipe floor mount |
| 4 | Notch | 59 | Pipe wall mount |
| 5 | Bolt hole | 60 | Plywood bracket |
| 6 | Base | 61 | Back |
| 7 | Floor mount | 62 | Floor web |
| 8 | Wall plate | 63 | Bolt holes |
| 9 | Side edge | 64 | Wall web |

-continued

| | | | |
|---|---|---|---|
| 10 | Top edge | 65 | Bolt holes |
| 11 | T-bar | 66 | Nose tab |
| 12 | Radiused right-angle bend | 66A | Nose tab bend |
| 13 | Topper edge | 67 | Safety pin |
| 14 | Bayonet bend | 68 | Tight opening |
| 15 | Core mount | 69 | Wrap |
| 16 | Cap | 70 | Tang |
| 17 | Heavy-duty core bracket | 71 | Opposite tang |
| 18 | Swan mount | 72 | Midspan wall Mount |
| 19 | Duck mount | 73 | Wall span |
| 20 | T-sides | 74 | Dog tab |
| 21 | T-curves | 74A | Dog tab bend |
| 22 | T-top | 75 | Bolt holes |
| 23 | T-notch | 76 | Pipe holes |
| 24 | T-shaped opening | 77 | Mid-span floor mount |
| 25 | Trough bend | 78 | Floor span |
| 26 | Outer trough bend | 79 | Bolt holes |
| 27 | J-side | 80 | Cat tab |
| 28 | J-top | 80A | Cat tab bend |
| 29 | Sider edge | 81 | Pipe holes |
| 30 | Tops edge | 82 | Triangular wall mount |
| 31 | Carriage bolt hole | 83 | Bracket |
| 32 | Rib | 84 | Offset floor mount |
| 33 | Cap | 85 | Party floor mount |
| 33A | Start bend | 86 | Bolt holes |
| 33B | End bend | 87 | Lip |
| 34 | Gooseneck bend | 88 | Hook latch |
| 35 | Head | 89 | Serni-circle base |
| 36 | Web | 90 | Catch opening |
| 36A | Web top | 91 | Latch top |
| 37 | Overthrust bend | 92 | Base hook latch |
| 38 | Web bend | 93 | Latch tab bend |
| 39 | Heavy-duty clip | 94 | Latch tab |
| 40 | Washer | 95 | Base plate |
| 41 | Washer side | 96 | Bolt hole |
| 42 | Bolt hole | 97 | Mid-span floor latch |
| 43 | Slit skirt | 98 | Latch span |
| 43A | Skirt bend | 99 | Latch cut-outs |
| 44 | Slit skirt cut-outs | 100 | Twist mount |
| 45 | Carriage bolt | 101 | Twist bend |
| 46 | Nut | 102 | Pipe hole |
| 47 | Rear bend | 103 | Wing tab |
| 48 | Shutter cover | 104 | Twist dock |
| 49 | Rear web | 105 | Lip dock |
| 50 | Circular bend | 106 | Circle dock |
| 51 | Skirt | 107 | Single mid-span floor latch |
| 52 | Radius notches | | |
| 53 | Stress relievers | | |
| 54 | Pipe clip | | |
| 55 | Pipe holes | | |
| 56 | Rear tab | | |

DESCRIPTION AND OPERATION

FIG. 1

Figure 1:
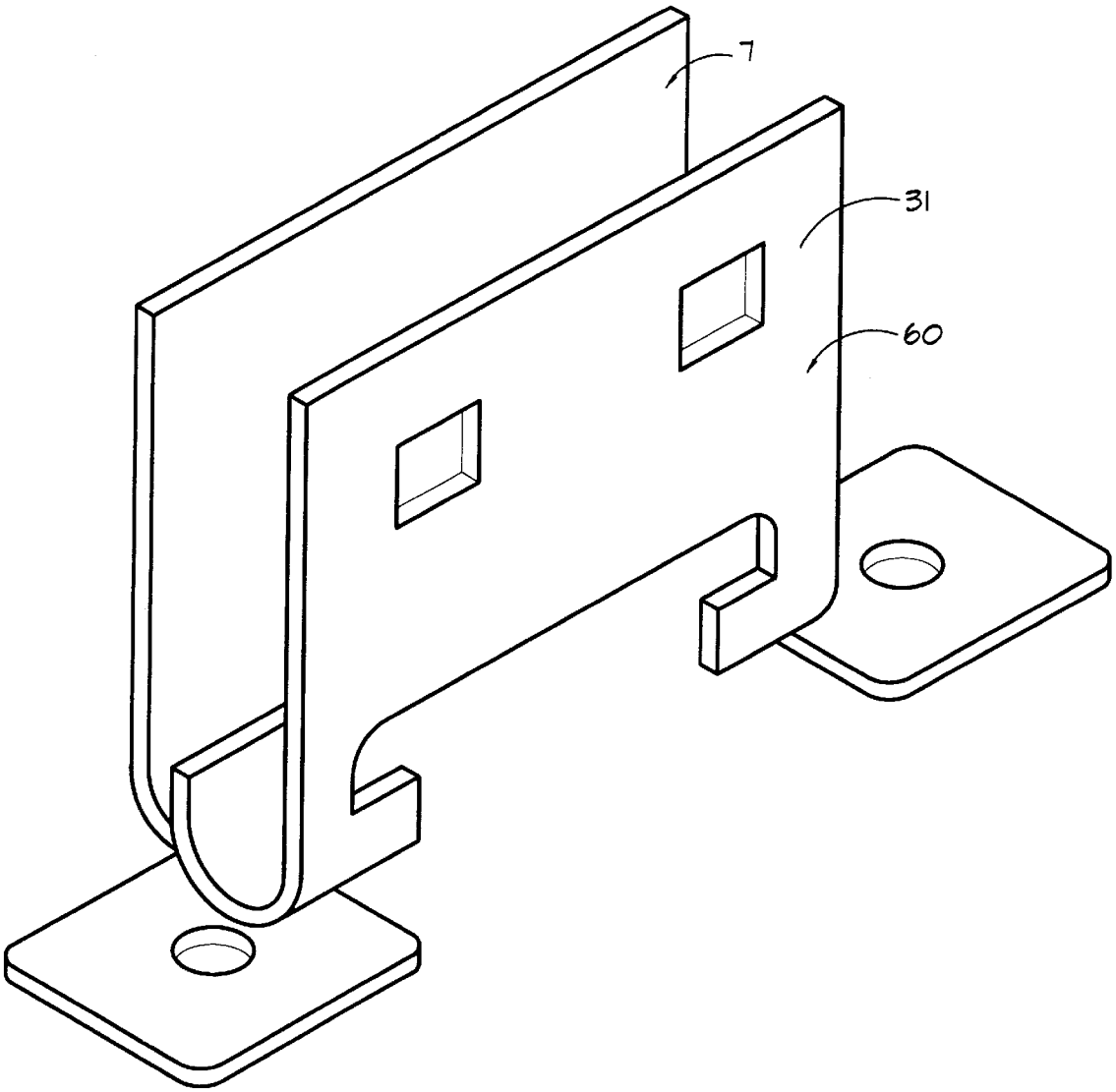
FIG. 1 shows a perspective view of a floor mount and plywood bracket.

FIG. 1 shows a perspective view of a floor mount 7 and plywood bracket 60 locked together at the bottom. The locking mechanism will be shown and explained in other figures. The shutter cover 48 is omitted from this view, but would be attached to the plywood bracket 60 using carriage bolts 45 through carriage bolt holes 31. It can be seen that the floor mount 7 and plywood bracket 60 would sandwich the shutter cover 48 providing much more surface holding power than many nails.

FIG. 2

Figure 2:
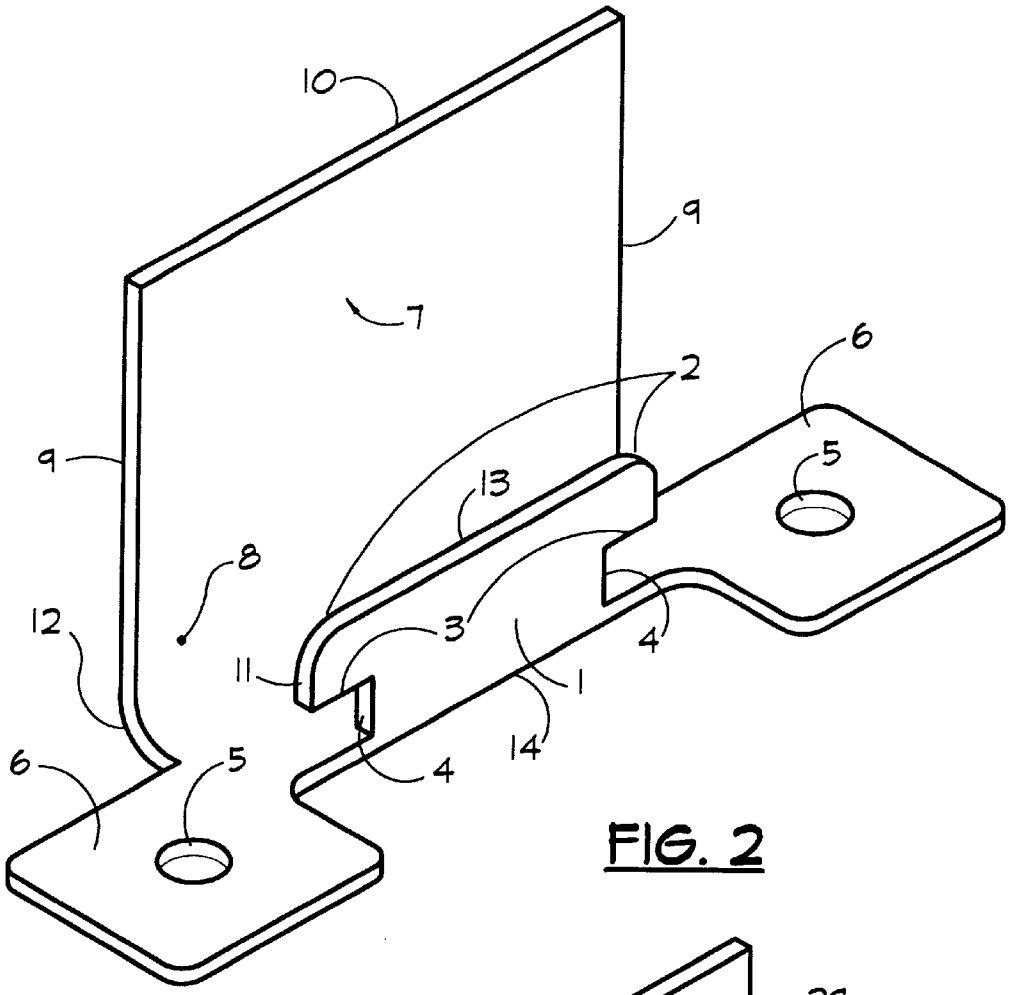
FIG. 2 shows a perspective view of a floor mount.

Refer now to FIG. 2 which shows a perspective view of a floor mount 7. The one-piece floor mount 7 consists of a base 6, on either end, with a bolt hole 5. In between each base 6 is a bayonet 1 that is bent up at a right angle at the bayonet bend 14. The bayonet 1 is T-shaped with the top edge 13 having radiused bends 2 at the end forming a T-bar 11. Under the T-bar 11, a notch 4 has a top side 3.

At the rear of the floor mount 7, a radiused right-angled bend 12 forms the wall plate 8 with side edge 9 and top edge 10. The wall plate 8 and bayonet 1 are generally parallel to each other.

FIG. 3

Figure 3:
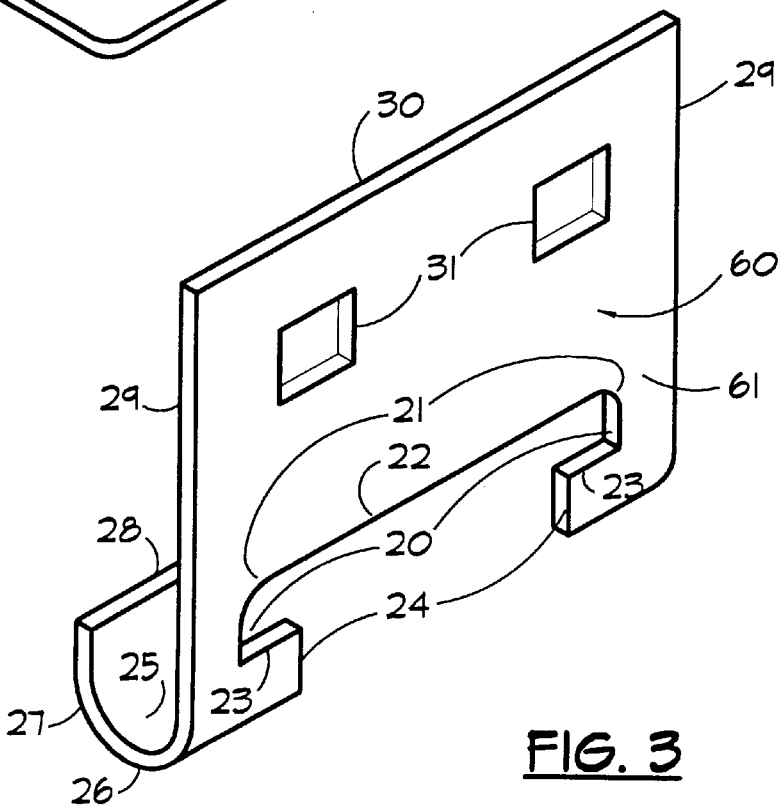
FIG. 3 shows a perspective view of a plywood bracket.

Refer now to FIG. 3 which shows a perspective view of a plywood bracket 60. The one-piece plywood bracket 60 is J-shaped in profile, and consists of a back 61 and trough bend 25. The back 61 has straight sider edges 29, tops edge 30, carriage bolt holes 31 near the top and T-shaped opening edges 24 near the center bottom.

The T-shaped opening 24 has a similar shape as the bayonet 1 on the floor mount 7, but is slightly larger. The T-top 22, T-curves 21, T-sides 20, and T-shaped opening 24 allow the bayonet 1 to hook through with the notch 4 locking onto the T-notch 23.

The trough bend 25 has a T-shaped opening 24 opposite the T-shaped opening 24 on the back 61, but is hidden in this view. It is shown on FIG. 12 of the full pattern layout. The trough bend 25 allows the plywood bracket 61 to rock up into a locked position by lifting on the shutter cover 48 (not shown here) .The plywood bracket 61 rocks on the outer trough bend 26 and the J-side 27 and J-top 28 completes the trough bend 25.

Figure 4:
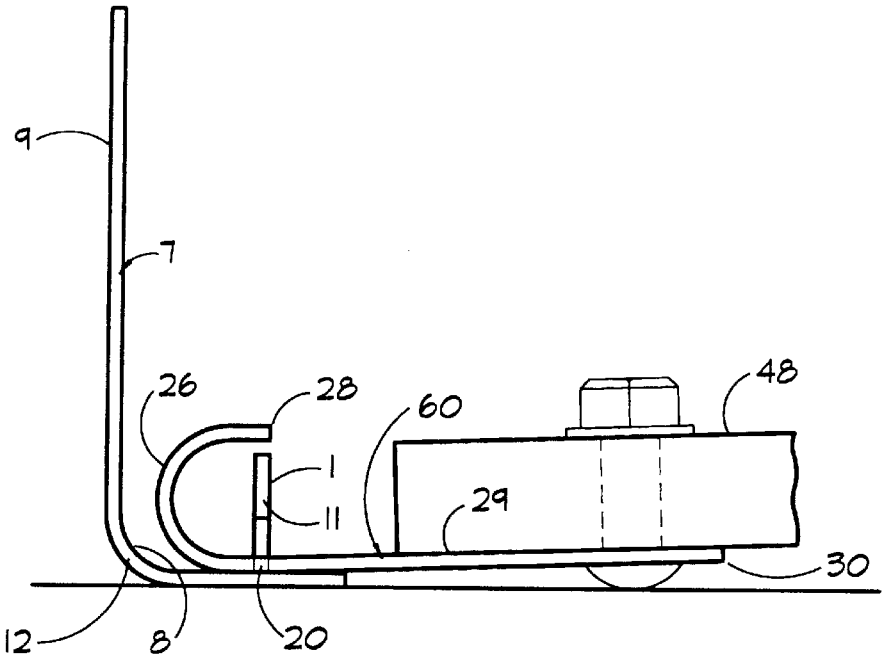
FIG. 4 shows a side view of a plywood bracket.

Once the plywood bracket 61 is placed on the floor mount 7, as shown in side view on FIG. 4, and rotated up, as shown in FIG. 1, the T-shaped opening edges 24 lock under the top side 3 of the floor mount 7.

FIG. 4

Refer now to FIG. 4 which shows a side view of a plywood bracket 60 placed on a floor mount 7, prior to locking. On the plywood bracket 60, a shutter cover 48 is mounted to the side edge 29 using a carriage bolt 45, nut 46, and washer 40. The bayonet 1 of the floor mount 7 is shown inserted between the T-sides 20 of the plywood bracket 60.

FIG. 5

Figure 5:
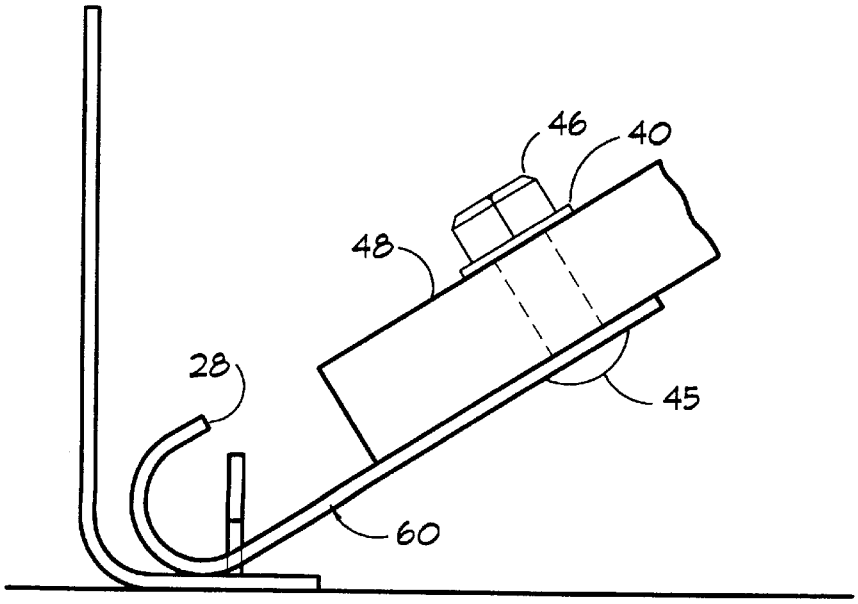
FIG. 5 shows the shutter cover attached to the plywood bracket.

Refer now to FIG. 5 which shows the shutter cover 48 attached to the plywood bracket 60 with carriage bolt 45, nut 46, and washer 40. The shutter cover 48 is lifted into position to cover a large window or door. Notice that the J-top 28 is upward.

FIG. 6

Figure 6:
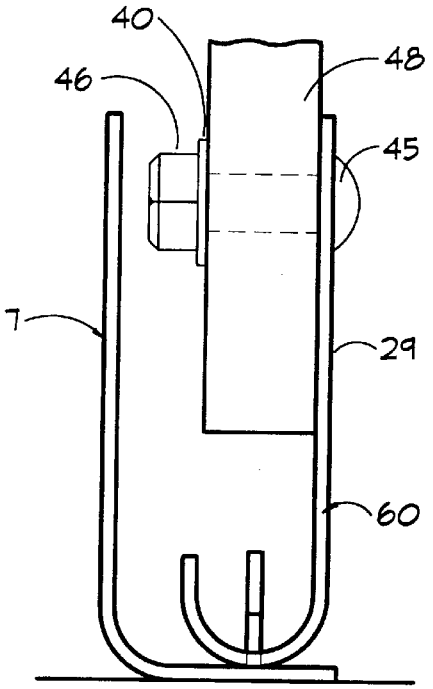
FIG. 6 shows the shutter cover locked into position.

Refer now to FIG. 6 which shows the shutter cover 48 locked into position and covering a large window or door. Notice the head of the carriage bolt 45 faces away from the window. This is a side view of the perspective view shown in FIG. 1. FIG. 6 shows the shutter cover 48 attached to the plywood bracket 60 using a carriage bolt 45, nut 46, and washer 40.

For extra clearance between the shutter cover 48 and the window, the shutter cover 48 can be bolted to the outside of the sider edge 29. FIG. 6 shows the shutter cover 48 attached to the inside of the sider edge 29, above the trough bend 25. The shutter cover 48 can also be bolted to the outside of the sider edge 29 so that in this view, the shutter cover 48 would be on the right side of the sider edge 29. This would provide for overlapping of the shutter covers 48 when the window or door is large and a single sheet of plywood could not completely cover the glass.

FIG. 7

Figure 7:
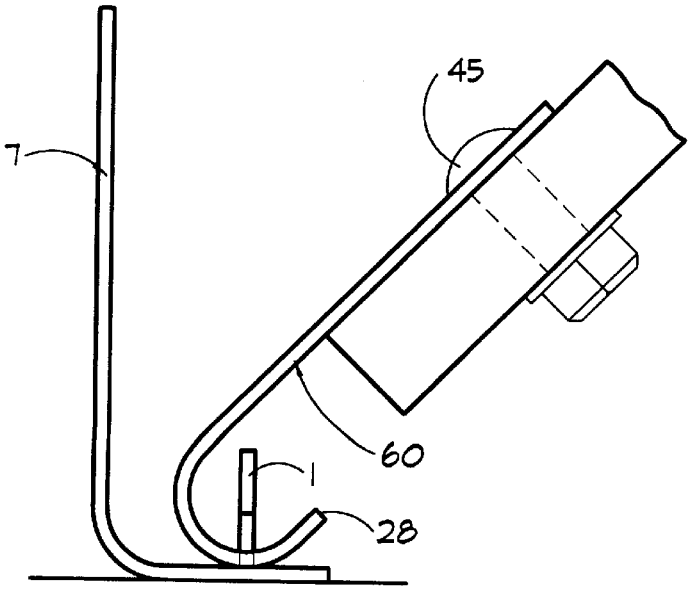
FIG. 7 shows the plywood bracket being lifted into position.

Refer now to FIG. 7 which shows the plywood bracket 60 being lifted into position to cover a large window or door.

Notice that the J-top 28 is downward as compared to FIG. 7. Since the t-shaped opening 24 is on both sides of the outer trough bend 26 (see FIG. 12), the plywood bracket 60 can latch on to the bayonet 1 with the J-top 28 facing the window or away from the window. This provides for warped shutter covers 48 so either side can face the window. Also, if the threads of the carriage bolt 45 are too long, the head of the carriage bolt 45 can face the window.

FIG. 8

Figure 8:
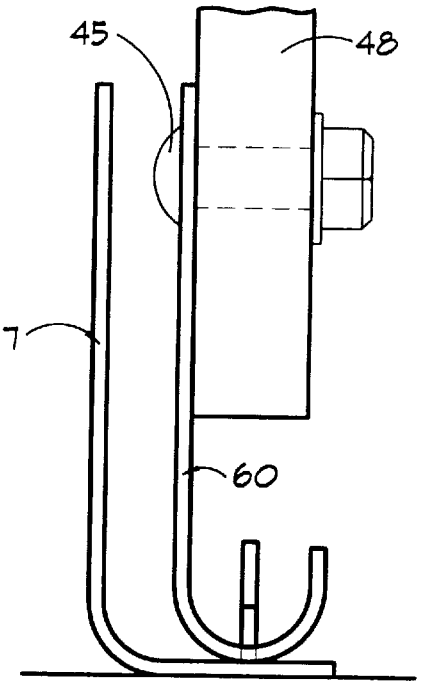
FIG. 8 shows the plywood bracket and attached shutter cover locked into position.

Refer now to FIG. 8 which shows the plywood bracket 60 and attached shutter cover 48 locked into position. The top part of the shutter cover is attached to the wall with locks. Note that the head of the carriage bolt 45 is next to the floor mount 7 as compared to FIG. 6.

FIG. 9

Figure 9:
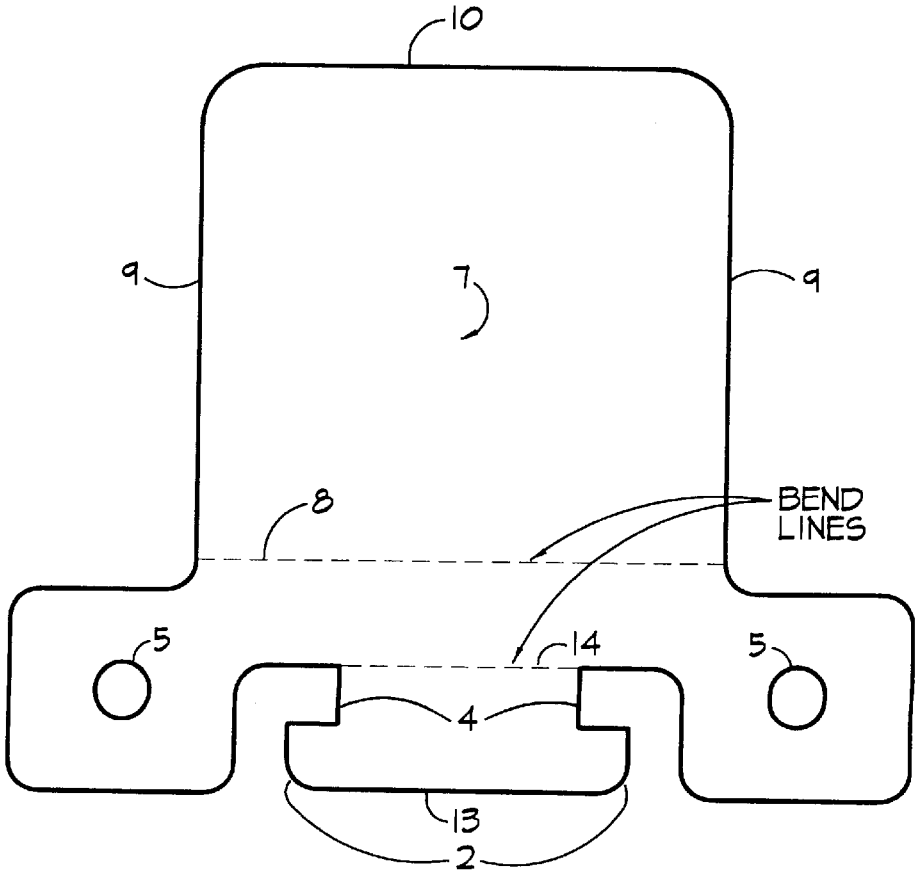
FIG. 9 shows a flat pattern layout of a floor mount prior to bending.

Refer now to FIG. 9 which shows a flat pattern layout of a floor mount 7 prior to bending. All parts and bend lines are labeled.

FIG. 10

Figure 10:
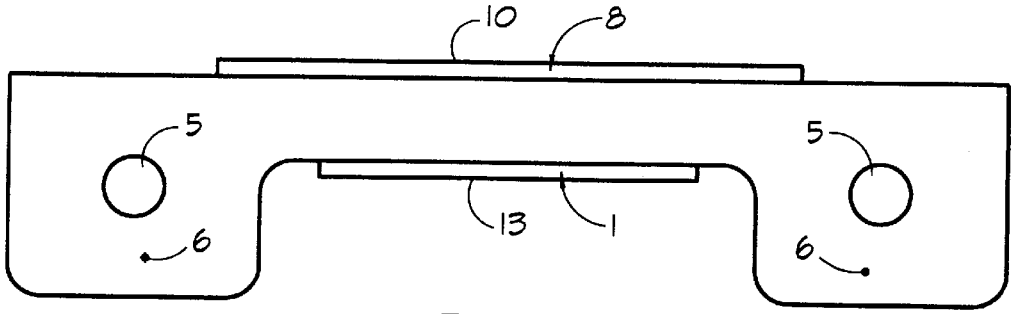
FIG. 10 shows a flat pattern layout of a floor mount after bending.

Refer now to FIG. 10 which shows a flat pattern layout of a floor mount 7 after bending. The topper edge 13 of the bayonet 1 now faces the viewer, along with the top edge 10 of the wall plate 8.

FIG. 11

Figure 11:
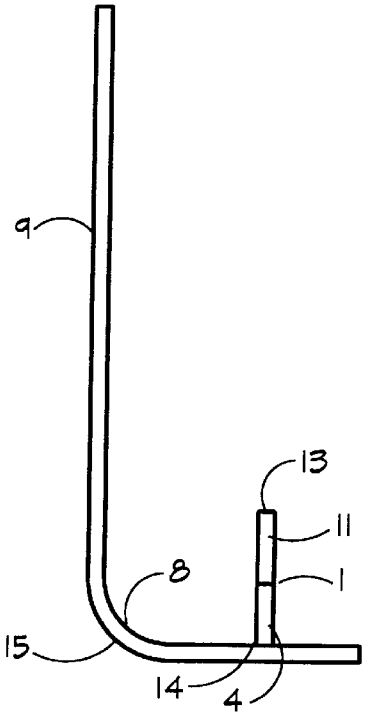
FIG. 11 shows a side view of the floor mount after bending.

Refer now to FIG. 11 which shows a side view of the floor mount 7 after bending. This view shows the radiused right-angle bend 12 and the sharp bayonet bend 14.

FIG. 12

Figure 12:
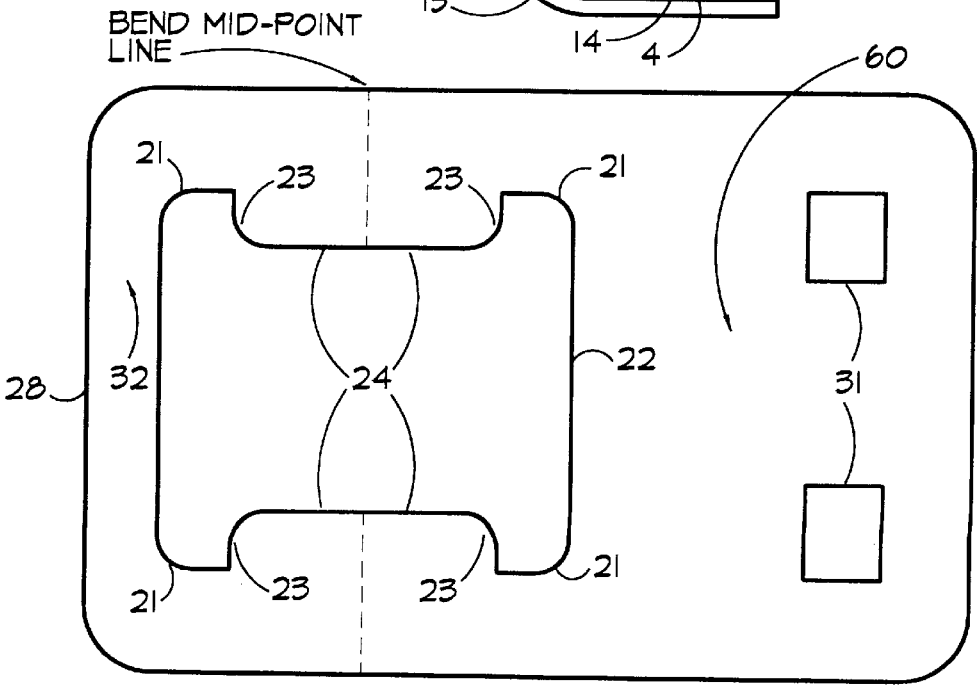
FIG. 12 shows a flat pattern layout of a plywood bracket prior to bending.

Refer now to FIG. 12 which shows a flat pattern layout of a plywood bracket 60 prior to bending. All parts and the bend line are labeled. This shows the T-shaped opening 24 will be on both sides of the trough bend 25 after bending.

FIG. 13

Figure 13:
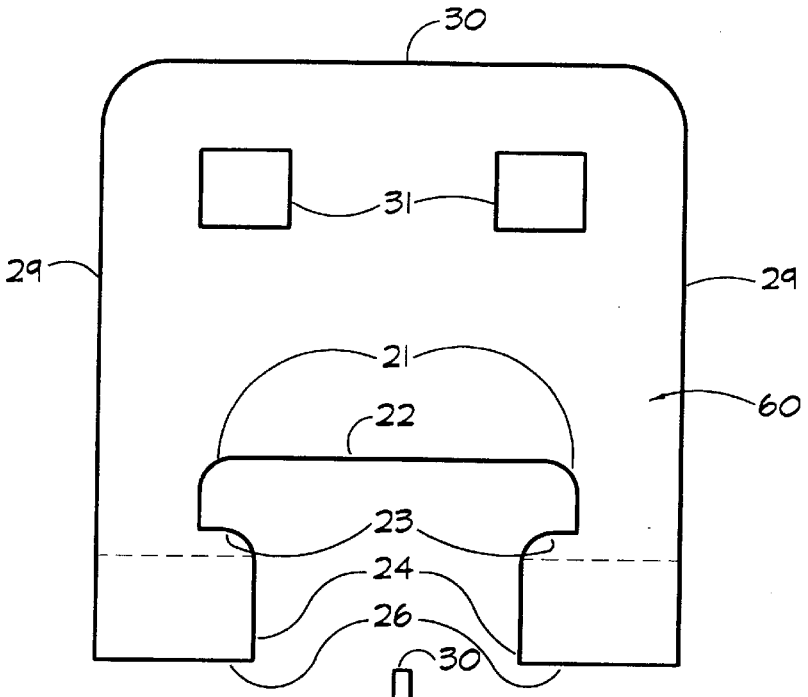
FIG. 13 shows a front view of a plywood bracket after bending.

Refer now to FIG. 13 which shows a front view of a plywood bracket 60 after bending. One can look clear through the T-shaped opening 24.

FIG. 14

Figure 14:
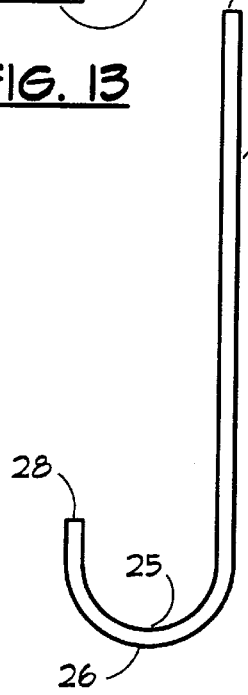
FIG. 14 shows a side view of a plywood bracket after bending, showing the J-shape.

Refer now to FIG. 14 which shows a side view of a plywood bracket 60 after bending, showing the J-shape.

FIG. 15

Figure 15:
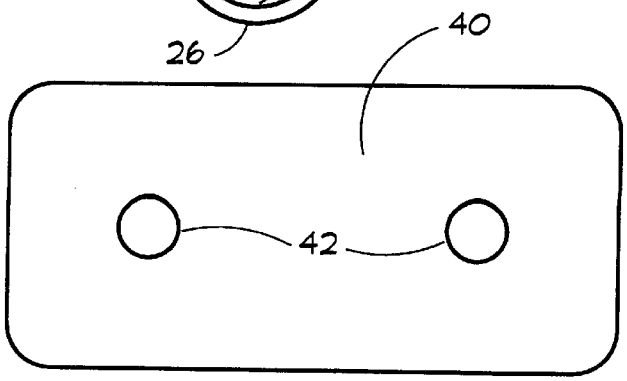
FIG. 15 shows a front view of the washer that adds strength to the shutter cover.

Refer now to FIG. 15 which shows a front view of the washer 40 that adds strength to the shutter cover 48. Carriage bolts 45 go through carriage bolt holes 31, through the shutter cover 48, through the bolt holes 42, and into the nuts 46. The washer 40 prevents the shutter cover 48 from splintering, distributes stresses over a wide area, and prevents pullout of the nut 46.

FIG. 16

Figure 16:
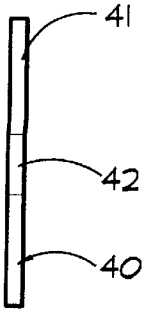
FIG. 16 shows a side view of a washer.

Refer now to FIG. 16 which shows a side view of a washer 40 and the washer side 41, and bolt holes 42.

FIG. 17

Figure 17:
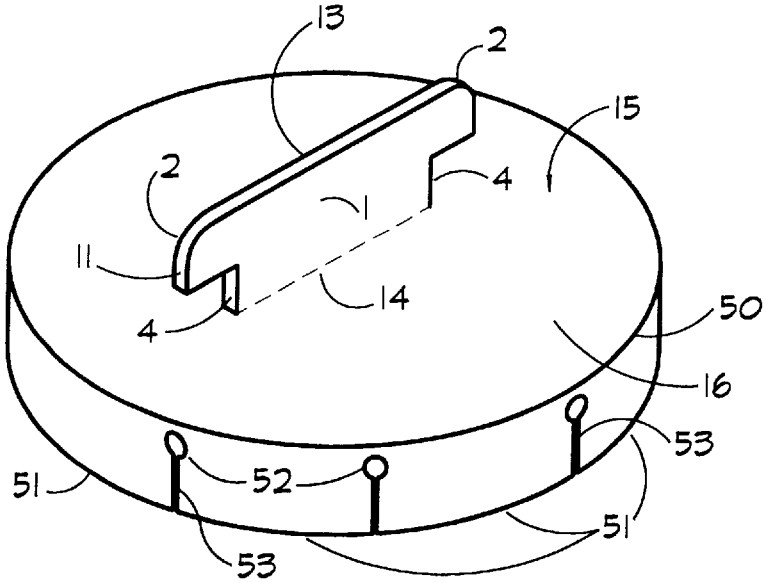
FIG. 17 shows an embodiment of a floor mount that can be epoxied to a concrete floor.

Refer now to FIG. 17 which shows an embodiment of a floor mount 7 that can be epoxied to a concrete floor, as would be found on a patio outside an apartment or condo. The core mount 15 has a bayonet 1 on the top, the same bayonet 1 as described in FIG. 2. The bayonet 1 is bent up from the cap 16 by the right-angled bayonet bend 14. The bayonet contains a notch 4, T-bar 11, radiused bends 2, and topper edge 13.

The cap 16 has a circular bend called the circumference bend 50 around the circumference. Adjacent to the bottom edge of the circumference bend 50 are a series of radius notches 52 and stress relievers 53. The radius notches 52 and stress relievers 53 form skirts 51 that are perpendicular to the cap 16. The radius notches 52 and stress relievers 53 help prevent the cap from distorting during bending of the circumference bend 50.

A coring bit with the same diameter as the cap 16 is used to drill a core hole in the concrete floor next to the patio door. After sufficient depth, the drill is removed but the core of the concrete remains, forming a circle in the concrete. This keeps the strength and integrity of the concrete, while providing extra surface area for the epoxy to adhere to.

Once the core circle is drilled, epoxy and the core mount 15 are inserted into the core circle. The skirts 51 are inserted into the core circle and the radius notches 52 and stress relievers 53 provide more edges for the epoxy to hold. The inner and outer surfaces of the skirts 51 provide edges for epoxy to grab. Also, any extra epoxy will grab onto the bottom surface of the cap 16.

Although the floor mount 7 could be mounted in the midpoint of a patio door, the wall plate 8 of the floor mount 7 may be hit by shoes of people walking out the patio door. The wall plate 8 could be eliminated, but it adds strength to the floor mount 7. The core mount 15 has strength from the cap 16 and skirts 51, so it could be used in the midpoint of a patio door.

Figure 20:
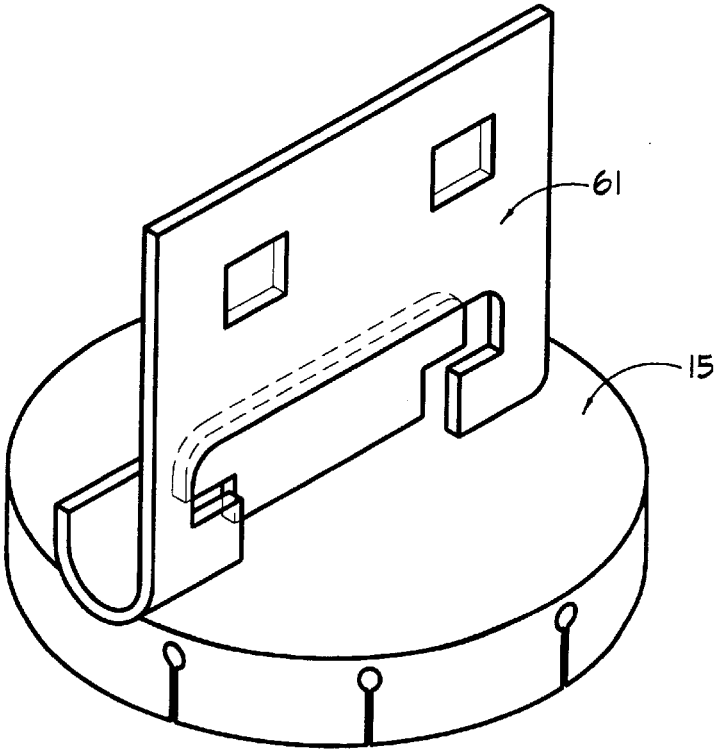
FIG. 20 shows a perspective view of a core mount after a plywood bracket has been latched and locked into position.

A plywood bracket 61 and attached shutter cover 48 could be latched and locked onto the bayonet 1 of the core mount 15 as shown in FIG. 20.

FIG. 18

Figure 18:
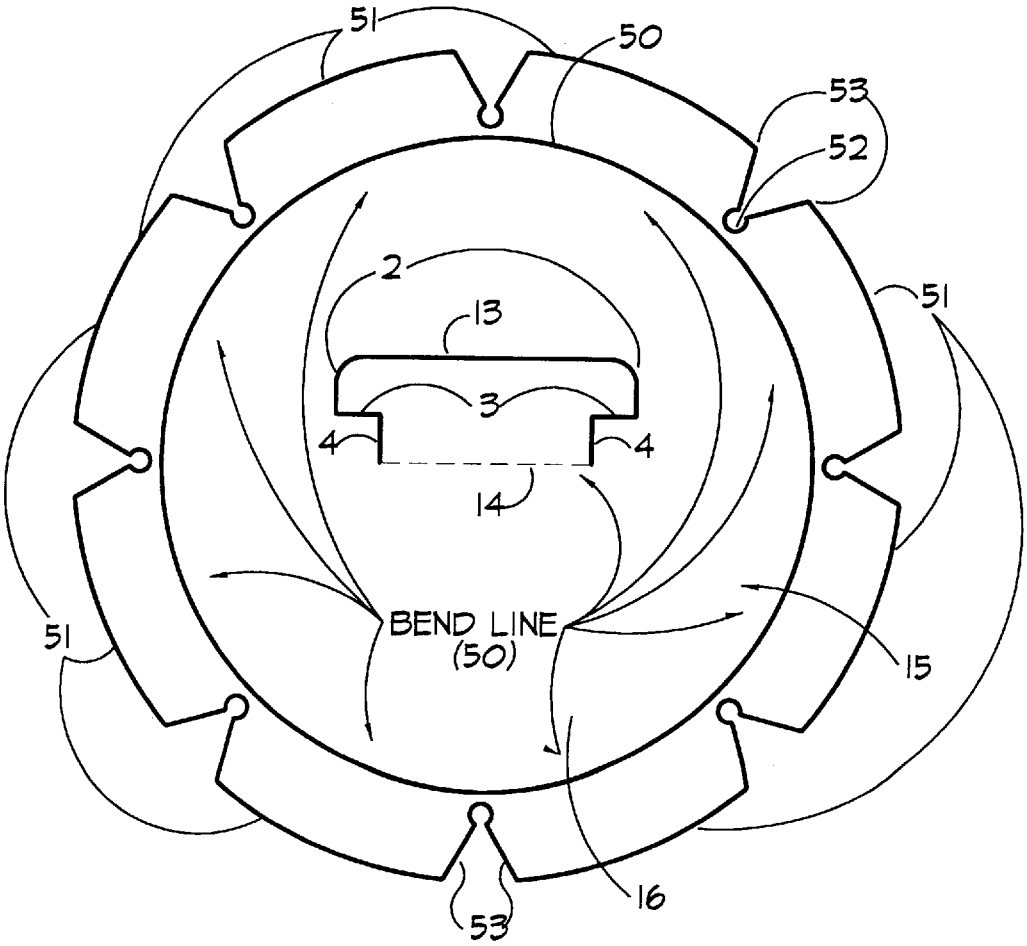
FIG. 18 shows a flat pattern layout of a core mount prior to bending at the bayonet bend and circumference bend.

Refer now to FIG. 18 which shows a flat pattern layout of a core mount 15 prior to bending at the bayonet bend 14 and circumference bend 50. Other parts are labeled as in FIG. 17.

FIG. 19

Figure 19:
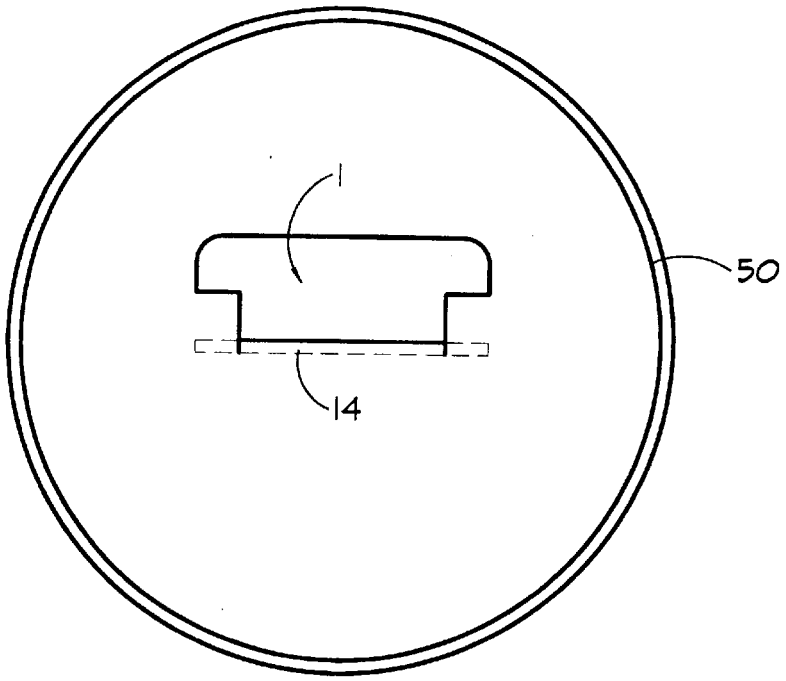
FIG. 19 shows a top view of a core mount after the circumference bend has been completed.

Refer now to FIG. 19 which shows a top view of a core mount 15 after the circumference bend 50 has been completed. The bayonet bend 14 will bend the bayonet 1 cutout up toward the viewer, shown by the dashed lines.

FIG. 20

Refer now to FIG. 20 which shows a perspective view of a core mount 15 after a plywood bracket 61 has been latched and locked into position. The shutter cover 48 is omitted from this view for clarity.

FIG. 21

Figure 21:
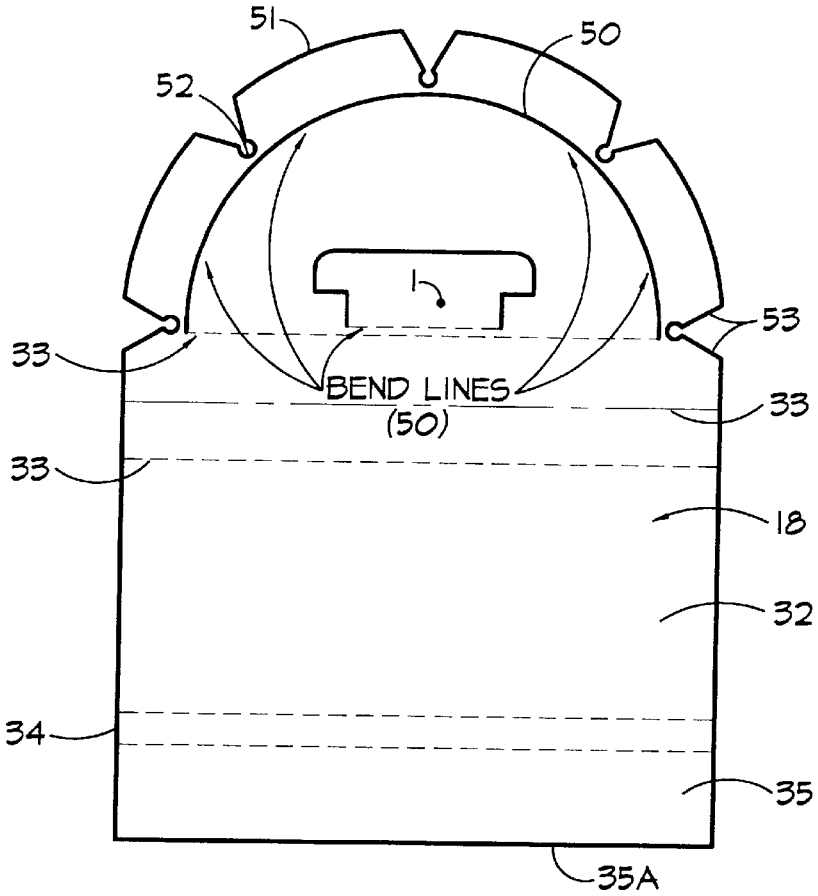
FIG. 21 shows a flat pattern layout of another embodiment of a core mount.

Refer now to FIG. 21 which shows a flat pattern layout of another embodiment of a core mount 15. The two-piece heavy-duty core bracket 17 uses the bayonet 1 of the floor mount 7, and the circumference bend 50, skirts 51, radius notches 52, and stress relievers 53 of the core mount 15.

FIG. 21 shows the flat pattern layout of a swan mount 18 prior to bending. The top part of the swan mount 18 is identical to about ½ of a core mount 15 as shown in the top half of FIG. 18. The bayonet 1 is shown near the center, with the circumference bend 50, radius notches 52, stress relievers 53, and skirts 51.

The bottom part of the swan mount 18 contains a rib 32 with a series of parallel bend lines. The cap bend 33 is a right-angle radius bend that forms the bulk of the rib 32 upward. The bend starts at the start bend 33A and ends at the end bend 33B, forming a gradual bend instead of a sharp bend. At the top of the rib 32, a gooseneck bend 34, containing a sharp overlapping bend, forms the head 35 and top head 35A.

A core drill is used to drill a core circle for epoxy and insertion of the skirts 51 of the swan mount 18, similar to insertion of the core mount 15 (FIG. 17) . Only ½ of the core circle is filled, as the duck mount 19 is inserted in the other half of the core circle, completing a two-piece heavy-duty core bracket 17.

FIG. 22

Figure 22:
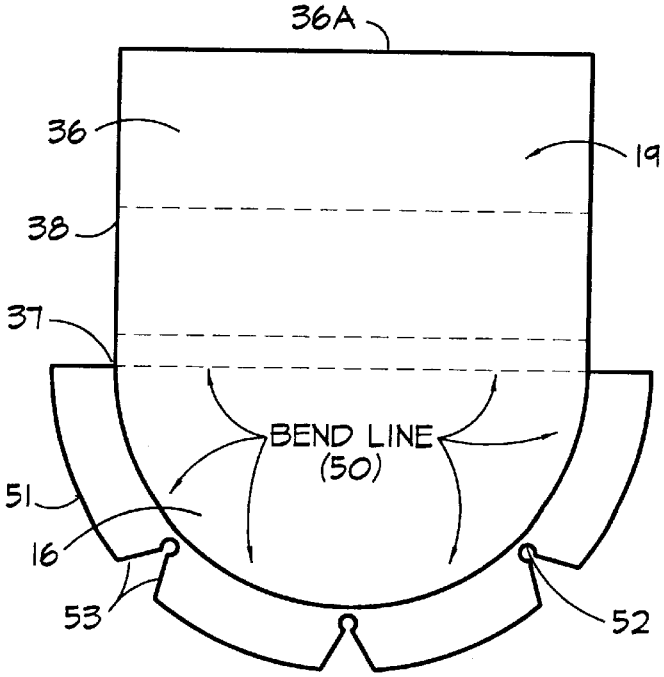
FIG. 22–26 shows the duck mount and swan mount.

Refer now to FIG. 22 which shows a flat pattern layout of a duck mount 19 prior to bending. The bottom part of the duck mount 19 is identical to about ½ of a core mount 15, except the bayonet 1 is missing. The circular bend 50, radius notches 52, stress relievers 53, and skirts 51 are similar to the swan mount 18 and core mount 15.

The top half of the duck mount 19 contains a web 36 with sharp bends. The overthrust bend 37 bends the web 36 on top of the cap 16. The right-angled web bend 38 bends the web 36 perpendicular to the cap 16, and ends with the web top 36A.

FIG. 23

Figure 23:
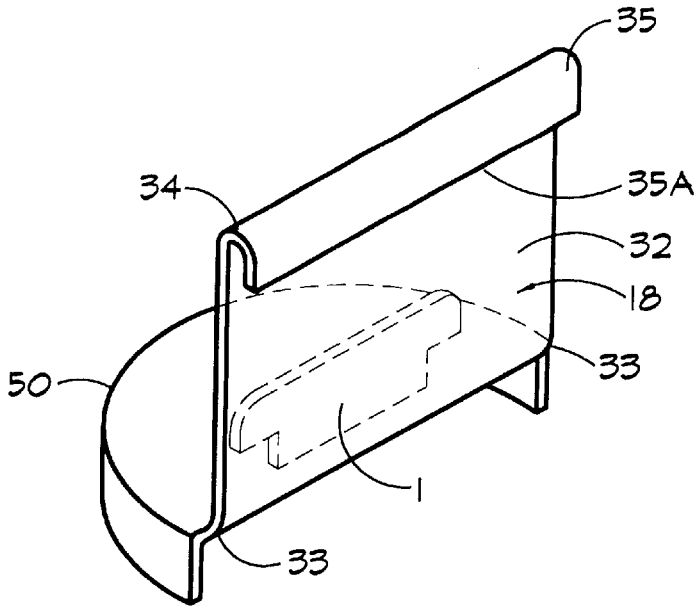

Refer now to FIG. 23 which shows a perspective view of a swan mount 18 after bending. The bayonet 1 is hidden from view and is dashed. The circumference bend 50 and skirts 51 are shown away from the viewer. The cap bend 33, rib 32, gooseneck bend 34, head 35, and top head 35A are shown toward the viewer. The base of the swan mount 18 is only about ½ a circle.

FIG. 24

Figure 24:
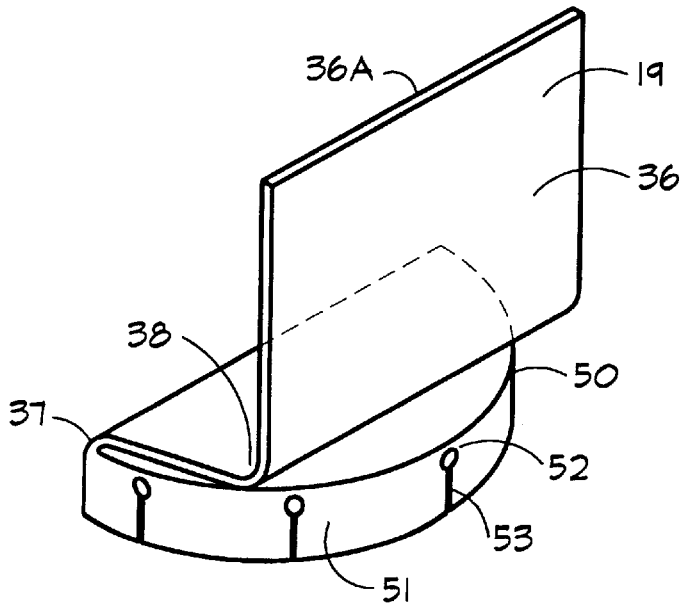

Refer now to FIG. 24 which shows a perspective view of a duck mount 19 after bending. The circumference bend 50, radius notches 52, stress relievers 53, and skirts 51 are shown toward the viewer. The overthrust bend 37 and web bend 38 form the web 36 and web top 36A.

FIG. 23A

Refer now to FIG. 23 which shows a perspective view of a swan mount 18 about to be put to a duck mount 19. The gooseneck bend 34 will capture the web top 36A of the duck mount 19, and the rib 32 will be against the web 36 of the duck mount 19.

FIG. 24A

Refer now to FIG. 24A which shows a perspective view of a duck mount 19 about to be united with a swan mount 18.

FIG. 24B

Refer now to FIG. 24B which shows a perspective view of a swan mount 18 and duck mount 19 mounted together forming a two-piece heavy-duty core bracket 17. This view has rotated 180° from FIG. 23A, so the bayonet 1 is toward the viewer. When the core circle is drilled into a concrete floor, epoxy and the heavy-duty core bracket 17 are inserted into the core circle. The bayonet 1 would face away from window to be protected, and the rib 32 would face the window. The rib 32 and attached web 36 add great strength in all directions.

FIG. 25

Figure 25A:
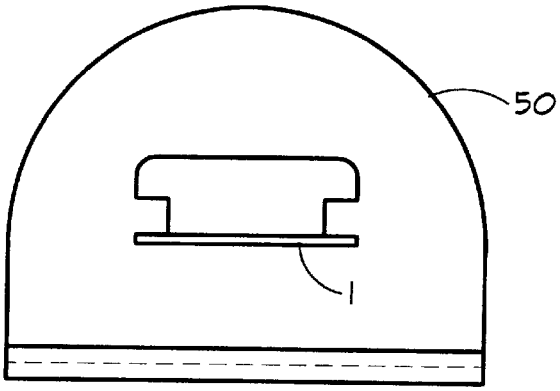
Figure 25:
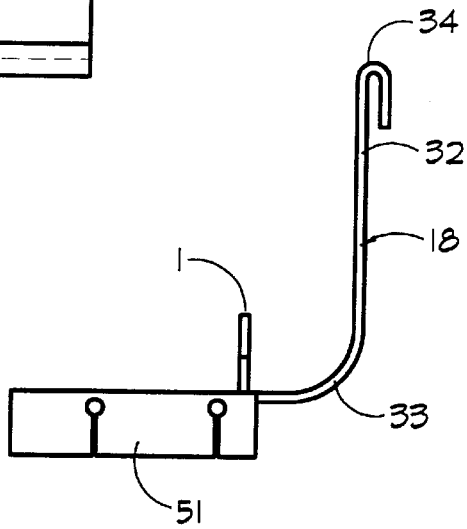

Refer now to FIG. 25 which shows a side view of a swan mount 18 with bayonet 1, skirts 51, cap bend 33, rib 32, and gooseneck bend 34.

FIG. 25A

Refer now to FIG. 25A which shows a top view of a swan mount 18 with bayonet 1, circumference bend 50, and gooseneck bend 34.

FIG. 26

Figure 26A:
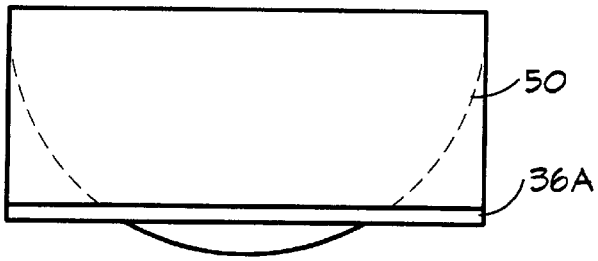
Figure 26:
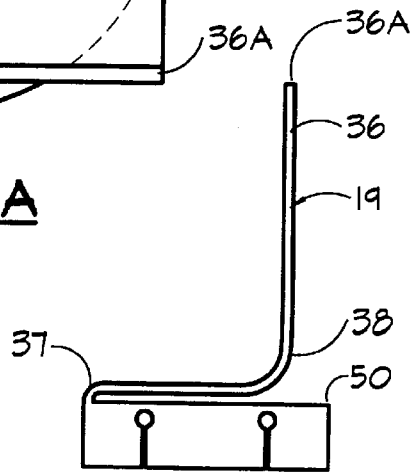

Refer now to FIG. 26 which shows a side view of a duck mount 19 showing the circumference bend 50, overthrust bend 37, web bend 38, web 36, and web top 36A.

FIG. 26A

Refer now to FIG. 26A which shows a top view of a duck mount 19 showing the circumference bend 50 and web top 36A.

FIG. 28H

Refer now to FIG. 28H which shows another embodiment of a floor mount 7, core mount 15, and heavy-duty core bracket 17. FIG. 28H shows a perspective view of a one-piece heavy-duty clip 39.The bayonet 1, circumference bend 50, radius notches 52, stress relievers 53, and skirts 51, the same as on previous brackets, are shown toward the front. The bayonet cutout 1A is shown clearly in this view.

Toward the rear, slit skirt cut-outs 44 form slit skirts 43 by a right-angled skirt bend 43A. The slit skirts 43 are the same length as the skirts 51, and are in the same circumference circle. A right-angle bend at the rear bend 47 forms the rear web 49. The rear web 49 adds great strength to the clip.

The heavy-duty clip 39 is inserted into a drilled core circle with epoxy, similar to the core mount 15 and heavy-duty core bracket 17. A plywood bracket 60 and shutter cover 48 are latched to the bayonet 1 as described for the plywood bracket 60.

FIG. 28F

Figure 28C:
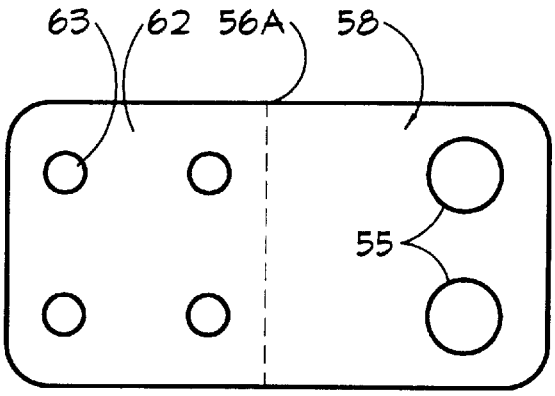
Figure 28D:
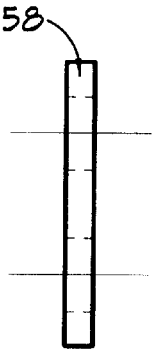
Figure 28A:
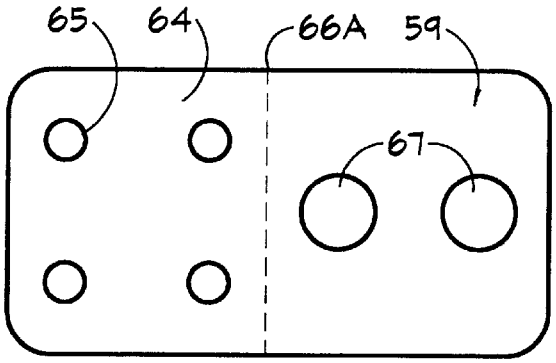
Figure 28B:
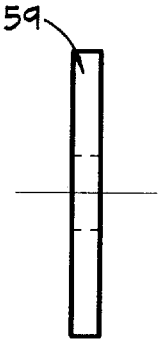
Figure 27E:
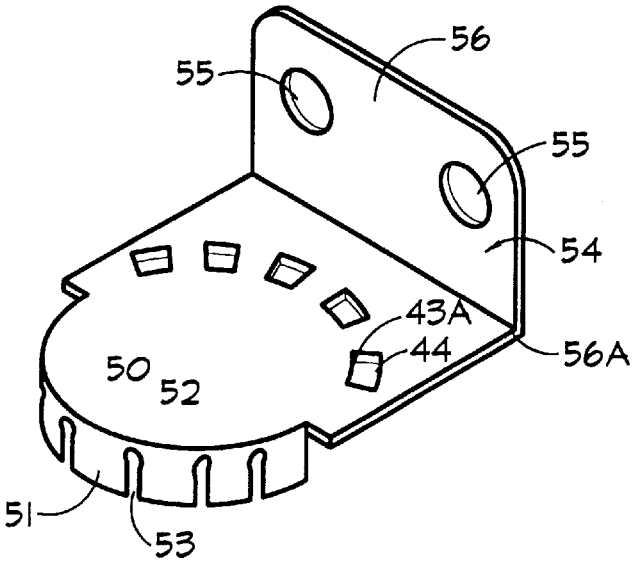
Figure 28E:
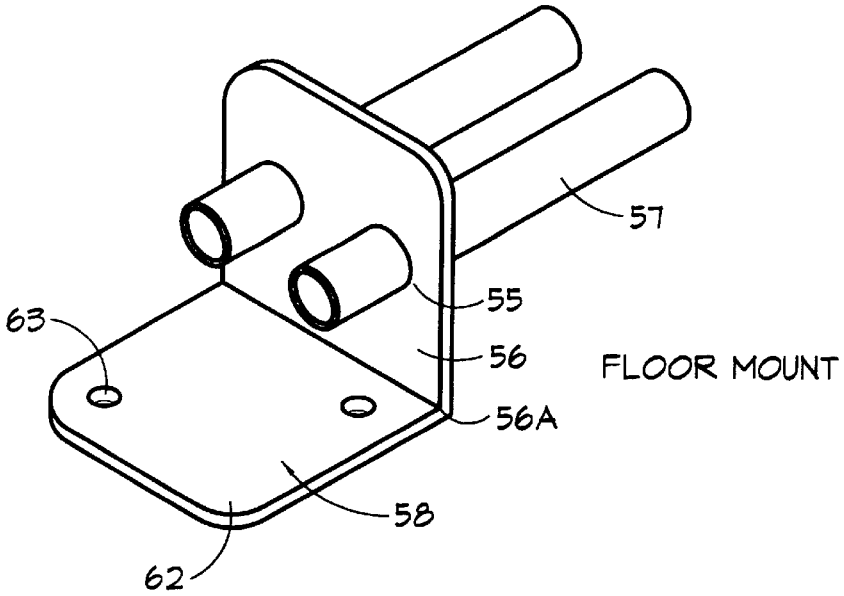
Figure 28F:
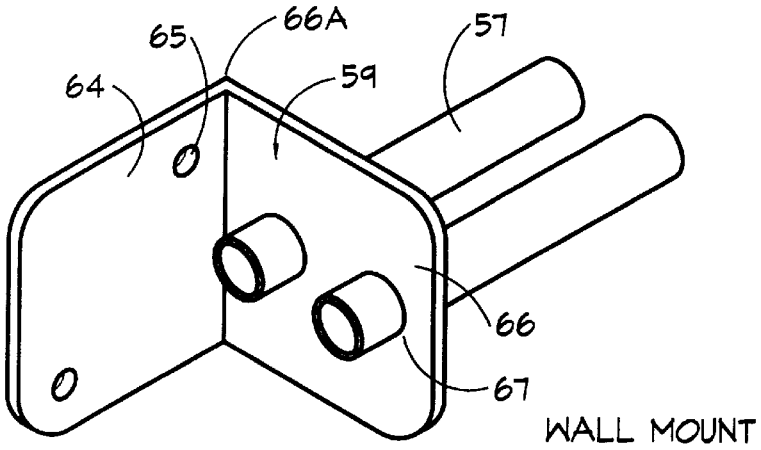

Refer now to FIG. 28F which shows a bottom view of a heavy-duty clip 39. The skirts 51 and slit skirts 43 are shown projecting toward the viewer, forming a circle that is the same diameter as a drilled core circle. The bayonet 1 is omitted for clarity in this view.

FIG. 28G

Figure 28G:
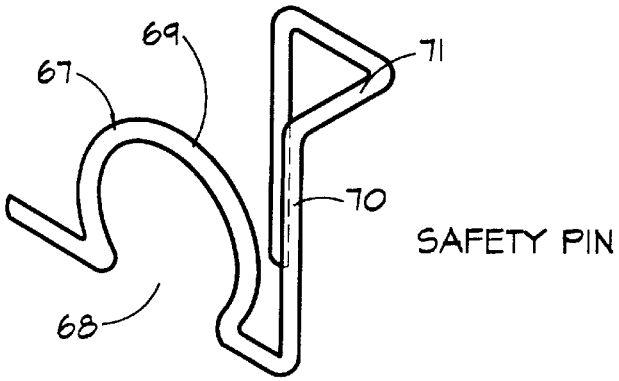
Figure 27F:
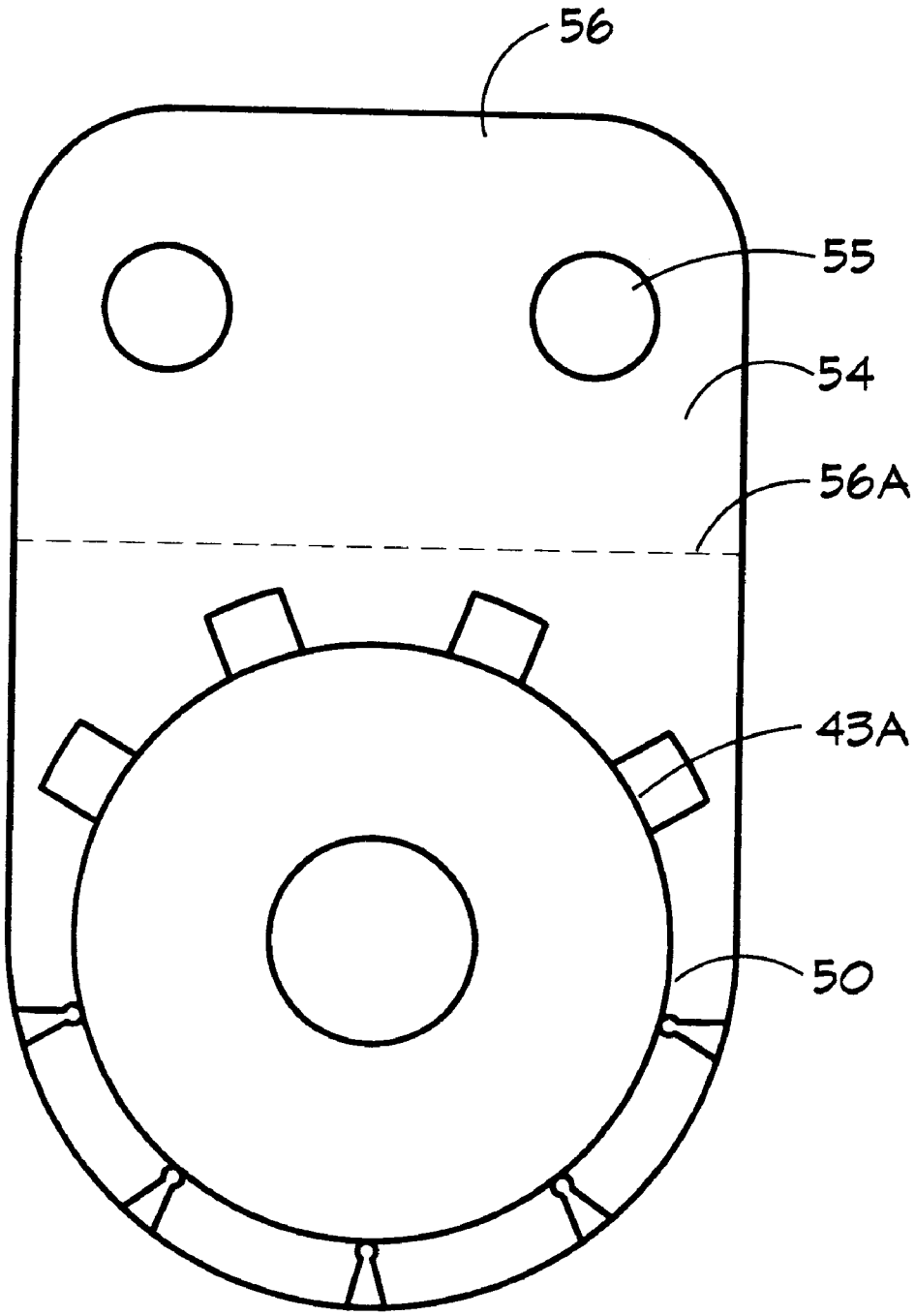

Refer now to FIG. 28G which shows a top view of a heavy-duty clip 39, showing the circumference bend 50, top edge of the rear web 49, slit skirt cut-outs 44, and skirt bend 43A.

FIG. 28

Refer now to FIG. 28 which shows that the slit skirts 43 could be formed in two ways. Circumference A is the circumference of a core drill. The slit skirts 43 could be cut at A–C and bent downward, or cut at A-B and bent downward. The skirt bend 43A is still at circumference A.

FIG. 28D

Refer now to FIG. 28D which shows an embodiment of a heavy-duty clip 39 for the pipe clip 54. Everything on the front is the same as the heavy-duty clip 39 except for the rear tab 56, which has pipe holes 55. The pipe clip 54 is inserted into a drilled core circle with epoxy, the same as a heavy-duty clip 39 except the pipe clip is rotated 90° so the rear tab 56 is perpendicular to the window. Standard pipes are inserted through the pipe holes 55 as shown on FIG. 45.

FIG. 27A

Figure 27D:
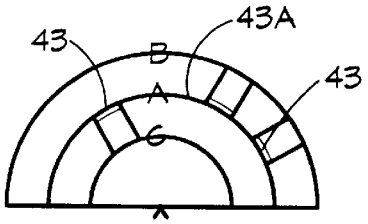
FIG. 27-28 shows another embodiment of the floor mount.
Figure 27B:
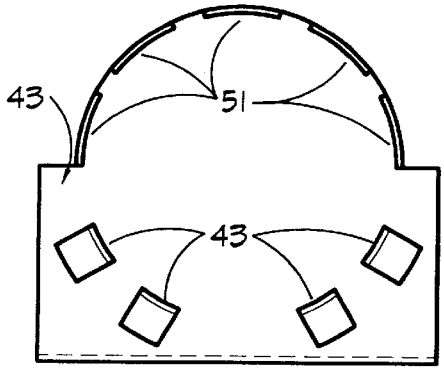
Figure 27C:
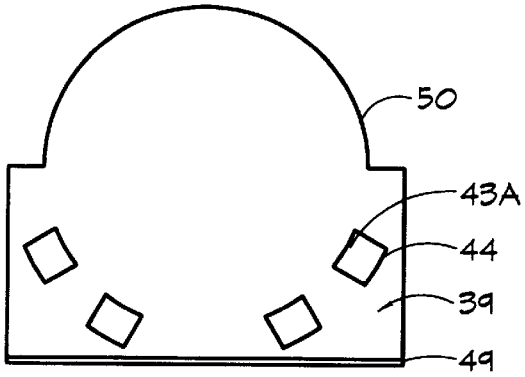
Figure 27A:
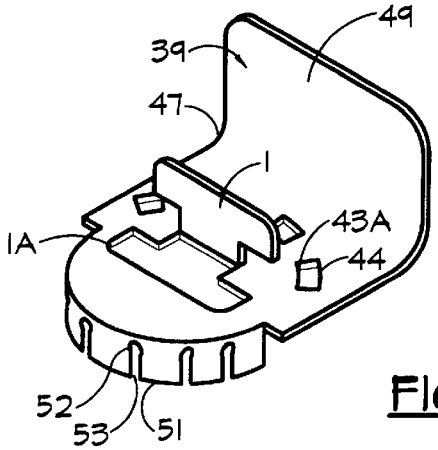

Refer now to FIG. 27A which shows a flat pattern layout of a pipe wall mount 59, prior to bending at the nose tab bend 66A.

FIG. 27B

Refer now to FIG. 27B which shows a side view of a pipe wall mount 59, prior to bending at the nose tab bend 66A.

FIG. 27C

Refer now to FIG. 27C which shows a safety pin 67 for securing pipe 57 to the pipe floor mount 58 and pipe wall mount 59. The safety pin 67 is bent from standard wire into the preferred shape. The tight opening 68 fits around the pipe 57 and the wrap 69 fits tightly to the pipe 57. The tang 70 is on one side of the nose tab 66 on the pipe wall mount 59, or on one side of the rear tab 56 of the pipe floor mount 58 and the opposite tang 71 is on the opposite side. This safety pin 67 quickly ties the pipe 57 to the rear tab 56 or nose tab 66.

FIG. 28A

Refer now to FIG. 28A which shows a perspective view of a mid-span wall mount 72 for use across a series of large windows or doors. The wall span 73 is flat and has bolt holes 75 for attachment to a door jamb or window frame. Right-angle dog tab bends 74A form dog tabs 74 that are parallel to each other. The dog tabs 74 contain pipe holes 76.

If a span is large, such as a patio door next to a picture window, the mid-span wall mount 72 can be attached to the door jamb by bolts through the bolt holes 75 on the wall span 73. The dog tabs 74 must be perpendicular to the floor, and the pipe holes 76 should be in line with the pipe holes 67 of a pipe wall mount 59, that is attached to the wall. Plywood is surrounded by pipe 57.

FIG. 28B

Refer now to FIG. 28B which shows a perspective view of a mid-span floor mount 77 for use across a series of large windows or doors. The floor span 78 is flat and has bolt holes 79 for attachment to the floor or deck. Right-angle cat tab bends 80A form cat tabs 80 that are parallel to each other. The cat tabs 80 contain pipe holes 81.

If a span is large, such as a patio door next to a picture window, the mid-span floor mount 77 can be attached to the floor by bolts through the bolt holes 79 on the floor span 78. The cat tabs 80 must be perpendicular to the wall, and the pipe holes 81 should be in line with the pipe holes 55 of a pipe floor mount 58, that is attached to the floor. Plywood is surrounded by pipe 57.

FIG. 28C

Refer now to FIG. 28C which shows a flat pattern layout for a mid-span wall mount 72 on the right, and a mid-span floor mount 77 on the left. The same tool and die can be used to make both mounts by moving pins for stamping of pipe holes 76 and 81.

FIGS. 29-30

Figure 29A:
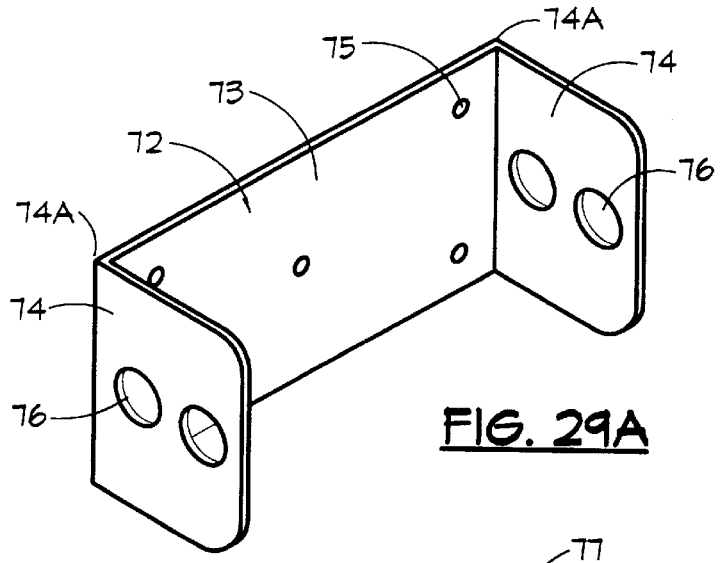
FIG. 29 shows a flat pattern layout for an offset floor mount using pipe.
Figure 29B:
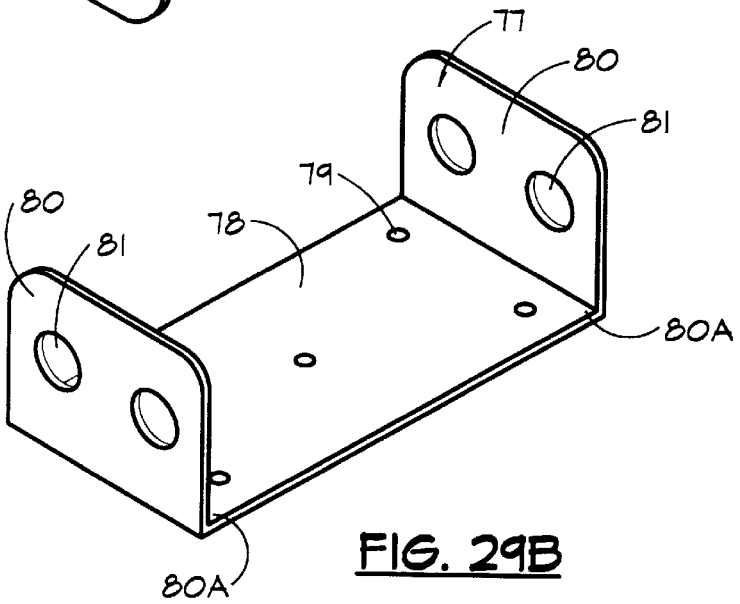
Figure 29:
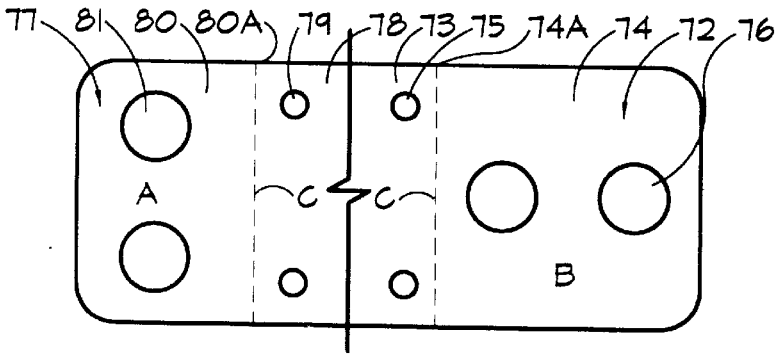
Figure 30:
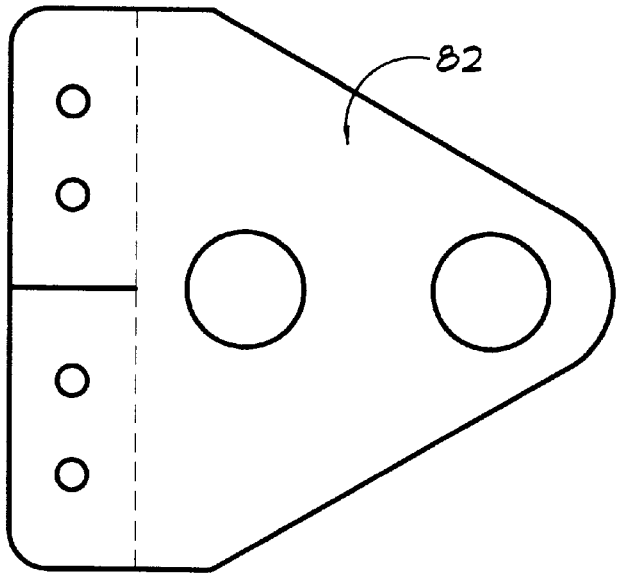
FIG. 30 shows the offset floor mount after bending.

Refer now to FIG. 29 which shows a flat pattern layout for an offset floor mount 84, again using pipe 57. FIG. 30 shows the offset floor mount 84 after bending.

FIGS. 31-32

Figure 31:
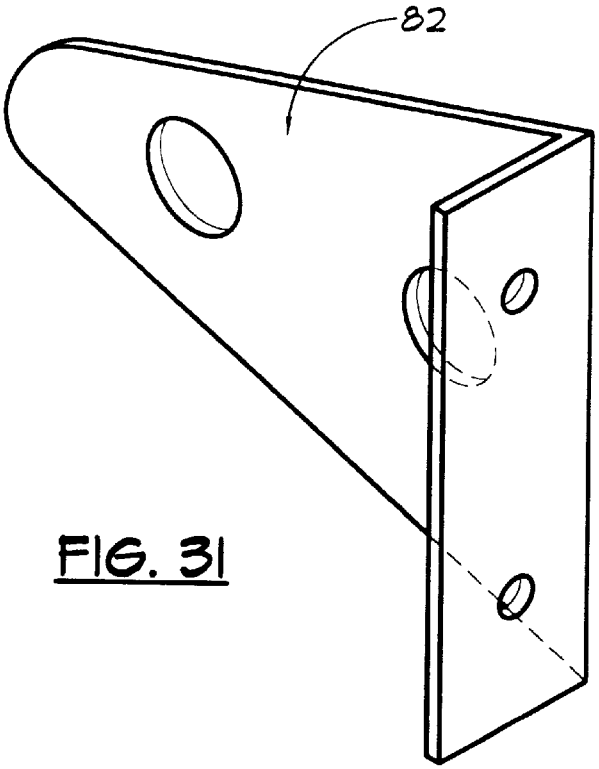
FIG. 31 shows a flat pattern layout for a party floor mount using pipe.
Figure 32:
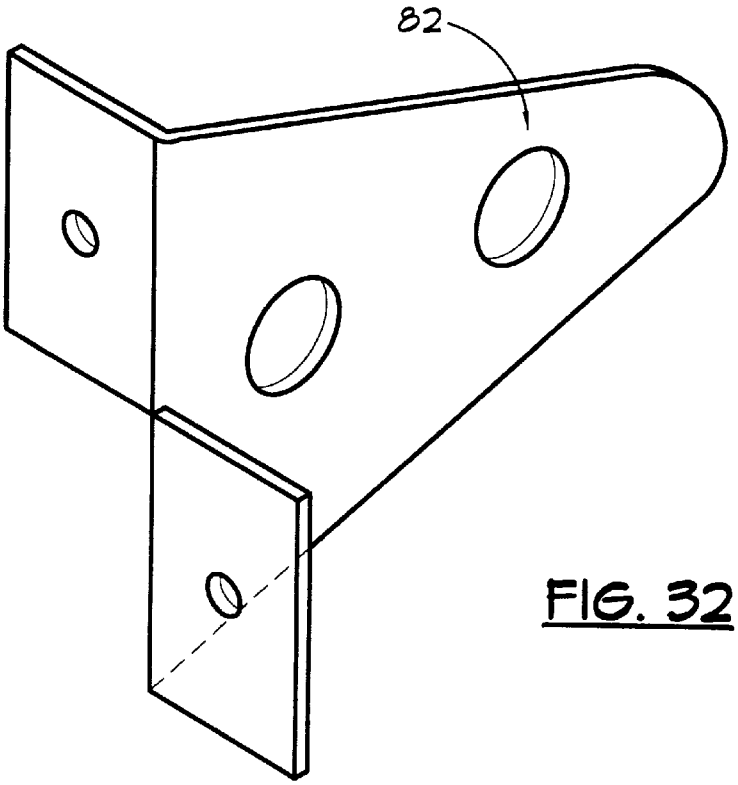
FIG. 32 shows the party floor mount after bending.
Figure 33:
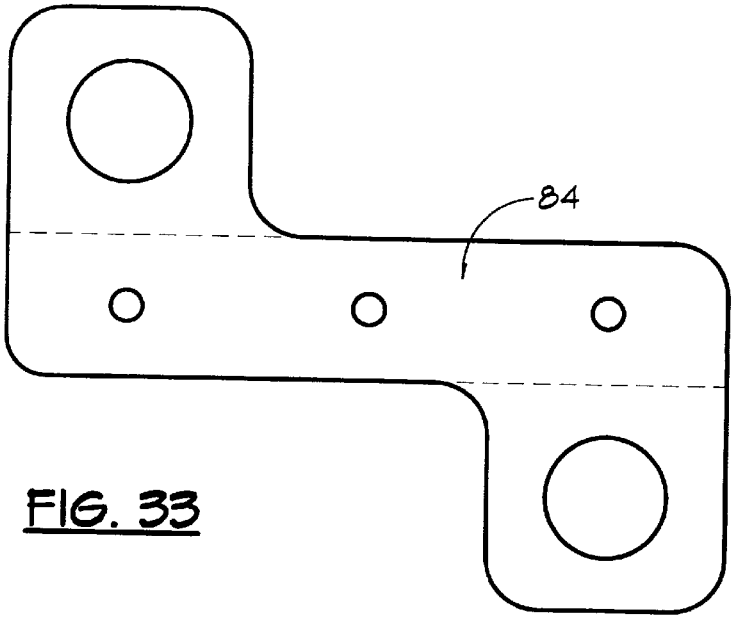
FIG. 33 shows a perspective view of an offset floor mount held securely to a structure by the same brackets.

Refer now to FIG. 31 which shows a flat pattern layout for a party floor mount 85, again using pipe 57. FIG. 32 shows the party floor mount 85 after bending.

FIGS. 32A-33, 34

Refer now to FIG. 32A which shows a perspective view of a party floor mount 85 held down securely to a structure by a bracket 83. The bracket 83 is permanently attached to a structure and the party floor mount 85 twists into the bracket 83 when a hurricane is imminent. The bracket 83 protects and adds strength to holding the party floor mount 85, pipe 57, and plywood securely to the house. FIG. 93 shows a perspective view of an offset floor mount 84 held securely to a structure by the same brackets 83.

The bracket 83 would be permanently attached to the house. When a hurricane approaches, a party floor mount 85 or offset floor mount 84 is placed along side the bracket 83 and twisted 90°. This puts the mounts inside the brackets 83. When pipe 57 is inserted through pipe holes of the mounts, the pipe prevents the mounts from twisting back, so the mounts stay in the brackets 83.

Figure 34:
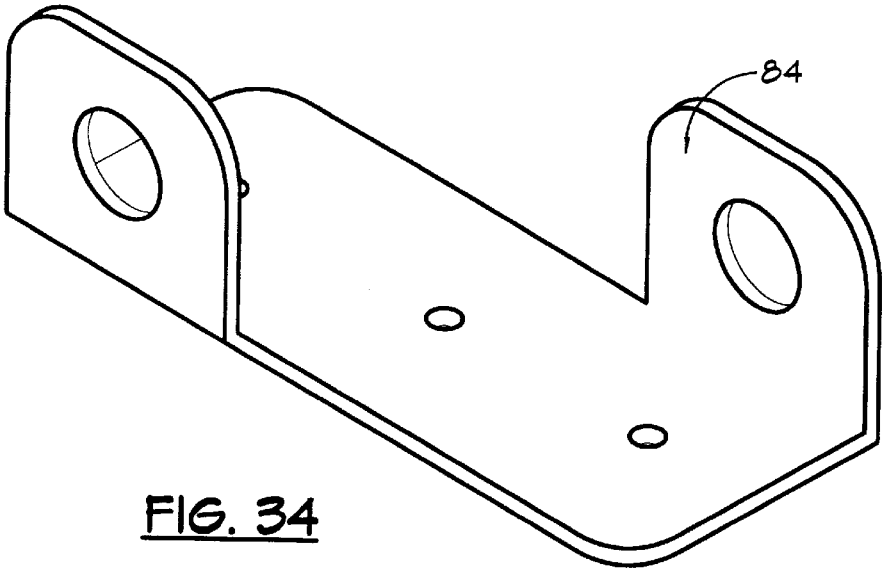
FIG. 34 shows a means of attaching the triangular wall mount to the wall using the same brackets.

FIG. 34 shows a means of attaching the triangular wall mount 82 to the wall using the same brackets 83. The brackets 83 are secured to the wall with the triangular wall mount 82 in the correct position. The triangular wall mount 82 is then twisted 90° counter-clockwise, releasing itself from the bracket 83. The bracket 83 stays permanently attached to the wall. When a hurricane comes, the triangular wall mount 82 can be quickly inserted into the bracket by twisting 90° clockwise. Pipe 57 keeps the triangular wall mount 82 from twisting, when the pipe 57 and plywood are installed. The party floor mount 85 and offset floor mount 84 are installed with brackets 83 in the same way.

FIG. 35

Figure 35:
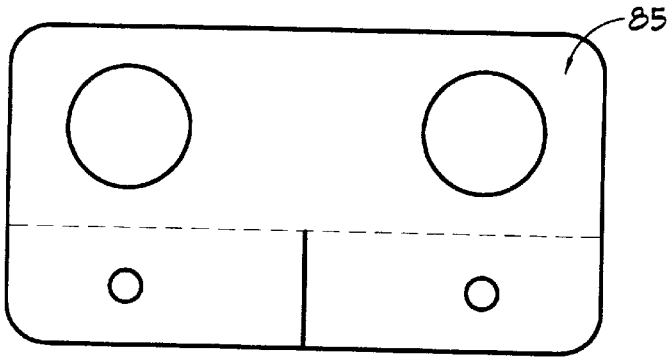
FIG. 35 shows a perspective view of two brackets.

Refer now to FIG. 35 which shows a perspective view of two brackets 83. The brackets are permanently attached to a structure using bolts through bolt holes 86. The lip 87 provides an offset, whereby a triangular wall mount 82, offset floor mount 84, or party floor mount 85 can be inserted in the brackets 83 by twisting the mounts 90° clockwise.

The shutter is locked using wingnuts of my previous patent application Ser. No. 08/597,194 of February 1996.

FIG. 36

Figure 36:
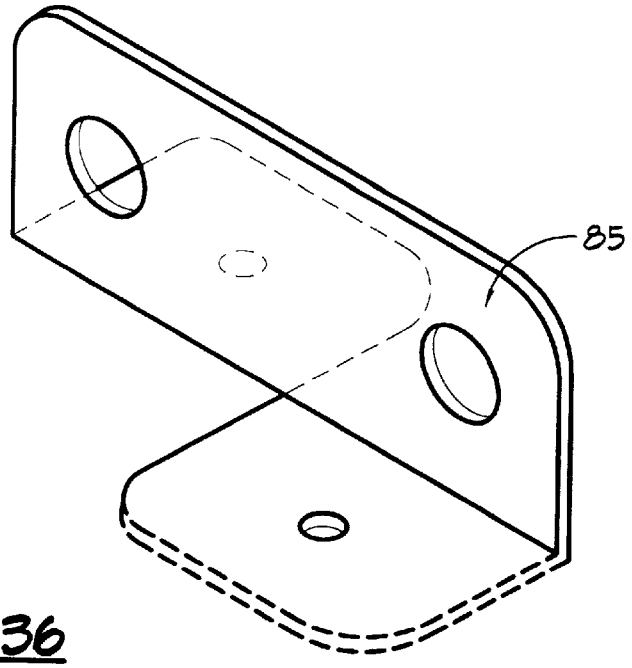
FIG. 36 shows a flat pattern layout of a hook latch prior to bending.

Refer now to FIG. 36 which shows another embodiment. FIG. 36 shows a flat pattern layout of a hook latch 88 prior to bending. FIG. 36 shows the semi circle base 89, catch opening 90, and latch top 91.

FIG. 37

Figure 37B:
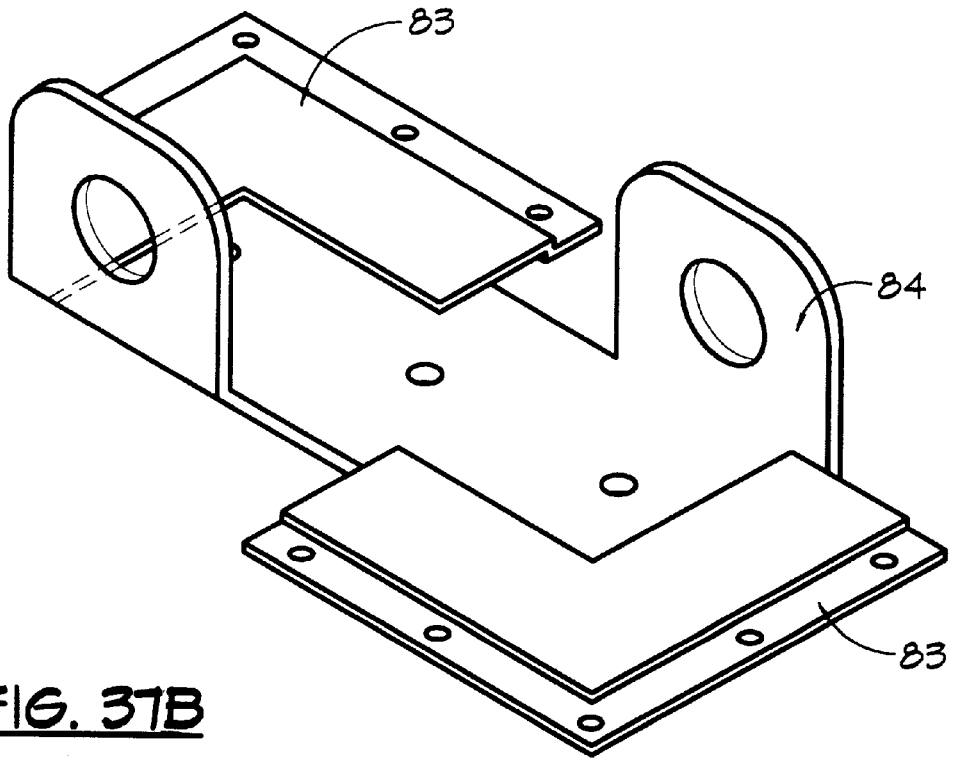
FIG. 37 shows a top view of a hook latch after bending.
Figure 37A:
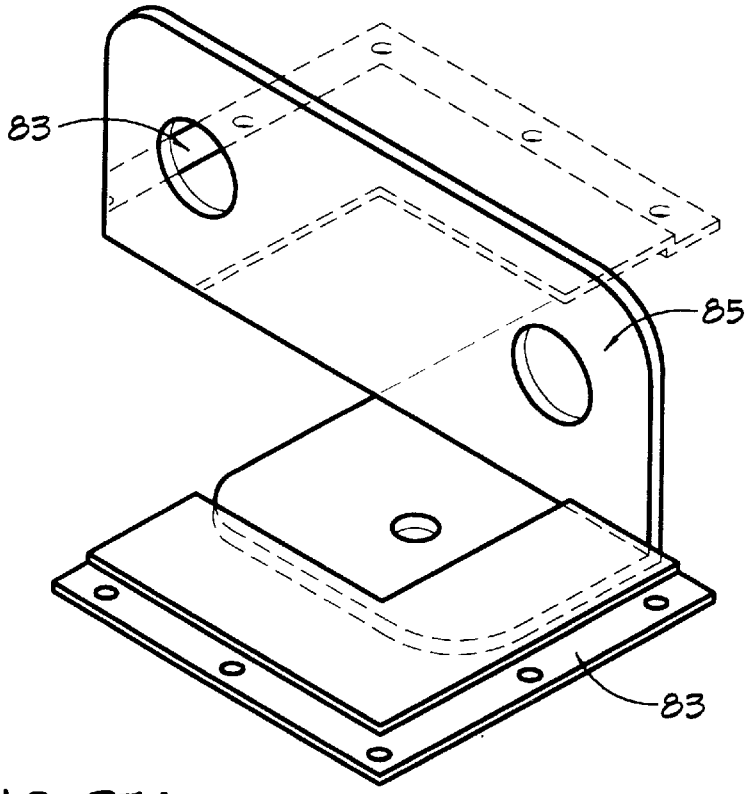

Refer now to FIG. 37 which shows a top view of a hook latch 88 after bending. The diameter of the semi-circular base 89 and latch top 91 is similar to a circular core drill mentioned previously. This view shows that another hook latch 88 can be placed next to this hook latch 88, forming a mostly complete circle, with a circumference equal to a drilled core circle. When a core drill circle is drilled in concrete, epoxy and two hook latches 88 can be inserted with the semi circle base 89 locked into the epoxy with the latch top 91 and catch opening 90 facing toward the window and away from the window.

FIG. 38

Figure 38:
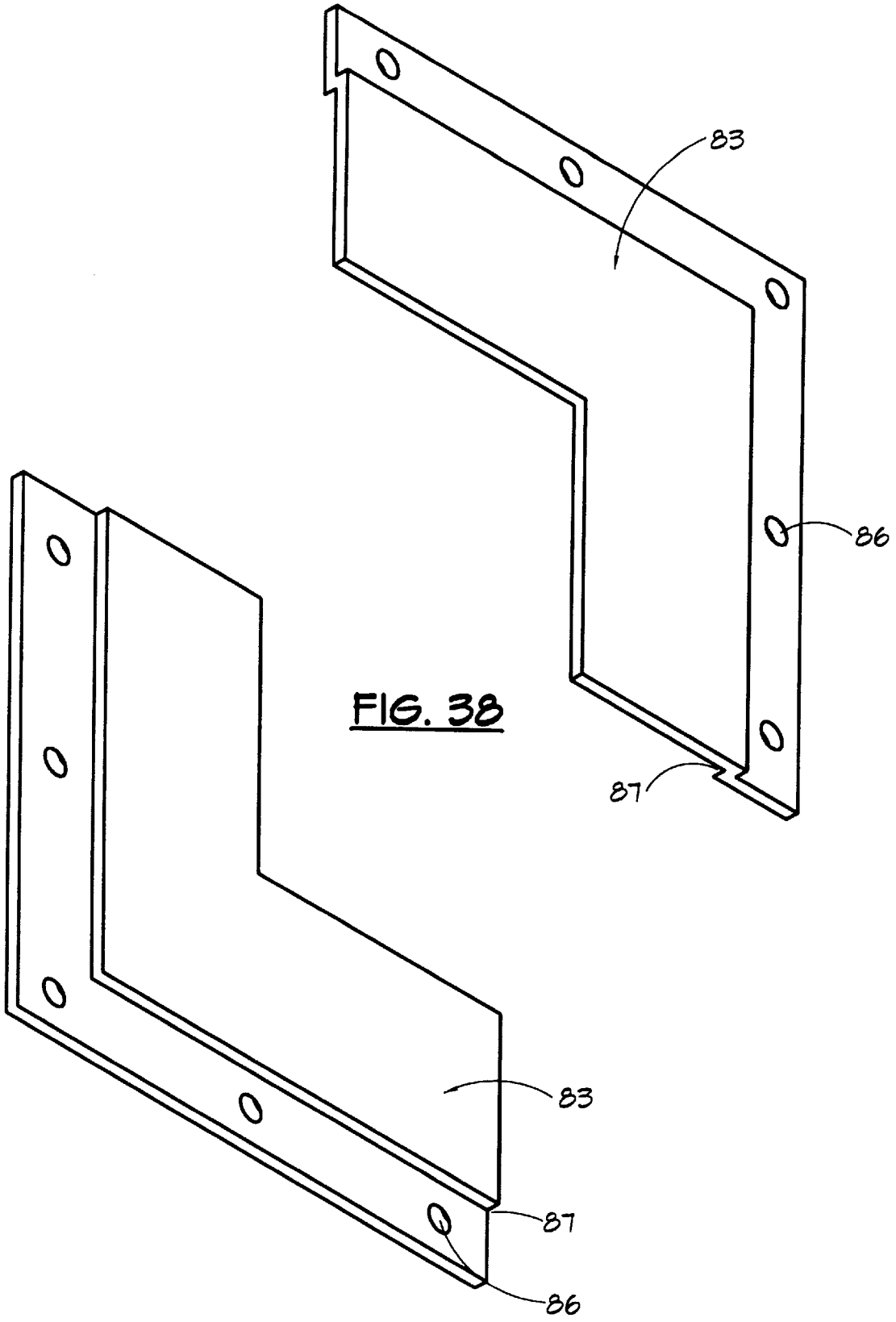
FIG. 38 shows a perspective view of a hook latch.
Figure 39A:
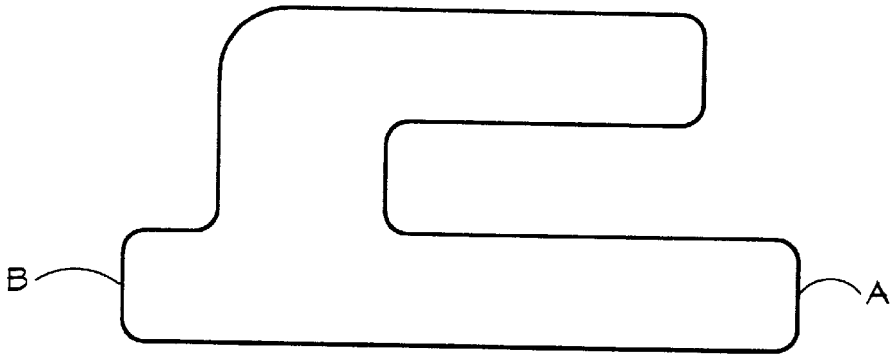
FIG. 39 shows an embodiment of a hook latch.
Figure 39B:
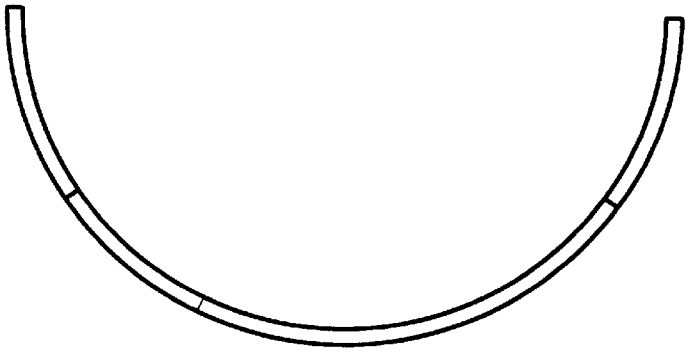
Figure 39C:
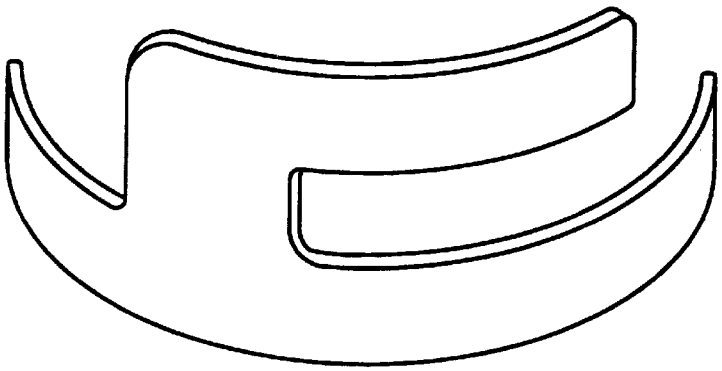
Figure 39D:
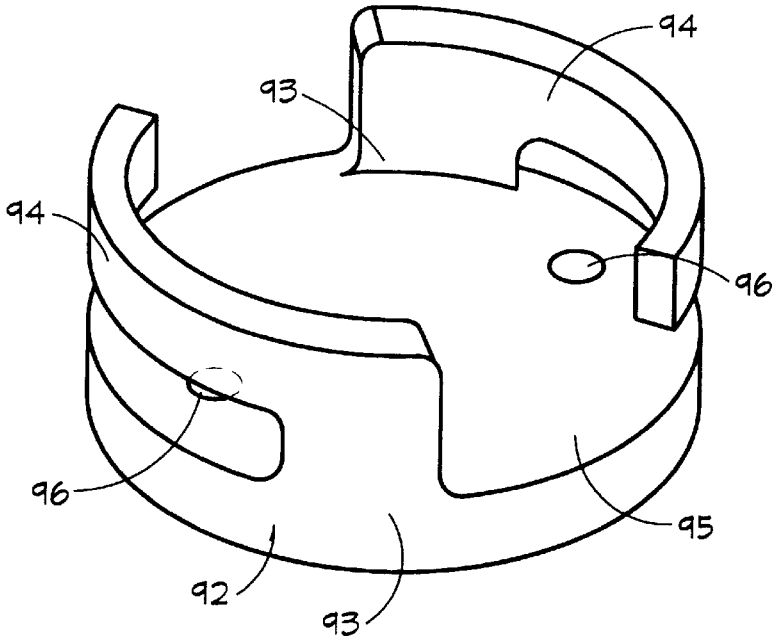
Figure 39E:
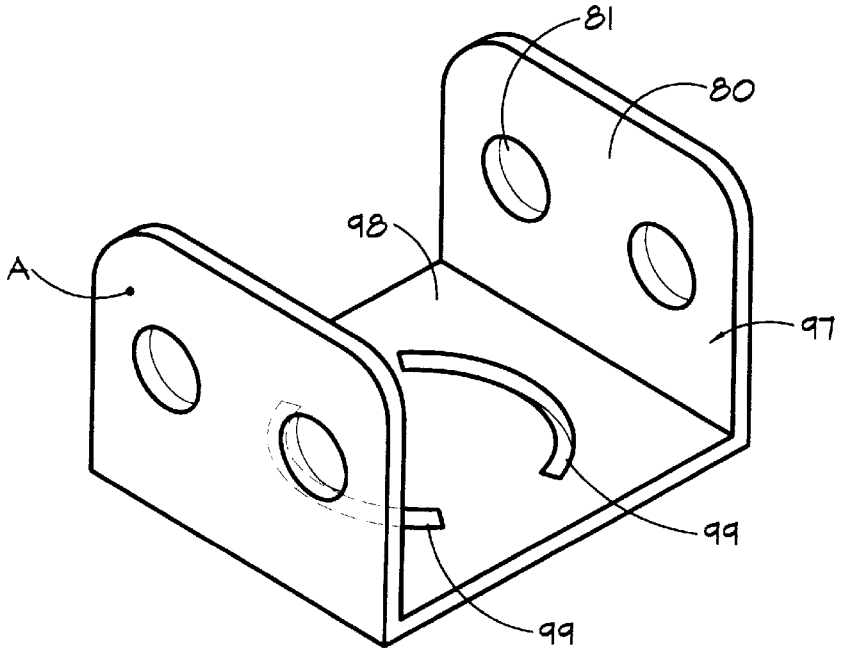

Refer now to FIG. 38 which shows a perspective view of a hook latch 88 showing the semi-circle base 89, catch opening 90, and latch top 91.

FIG. 39

Refer now to FIG. 39 which shows an embodiment of a hook latch 88. The one-piece base hook latch 92 has the same circumference as a hook latch 88, but has both latches together on a plate that can be bolted to wood or concrete. The base plate 95 has bolt holes 96 for attachment to wood or concrete. The latch tabs 94 are similar to the latch top 91 on the hook latch 88. The base hook latch 92 is formed with a circular base plate 95 and the latch tabs 94 are bent up at a generally right angle circular bend at the latch tab bend 93. The base hook latch 92 is bolted to the structure with latch tabs 94 facing toward the window and away from the window.

FIG. 40

Figure 40A:
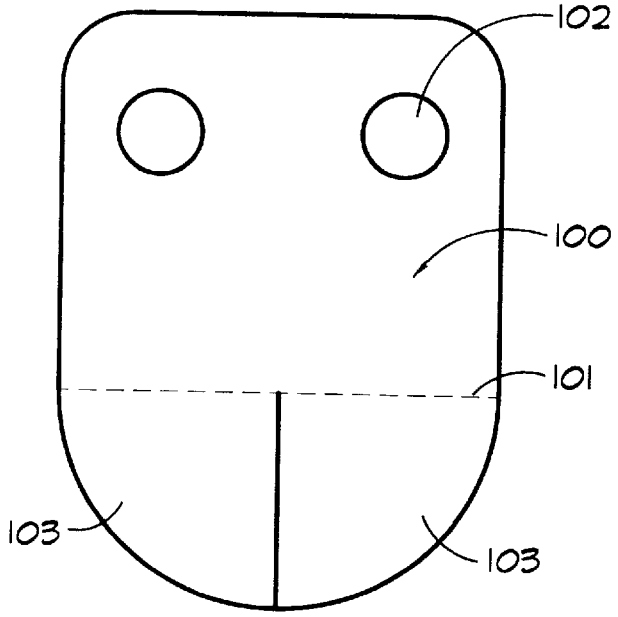
FIG. 40 shows an embodiment of a mid-span floor mount.
Figure 40B:
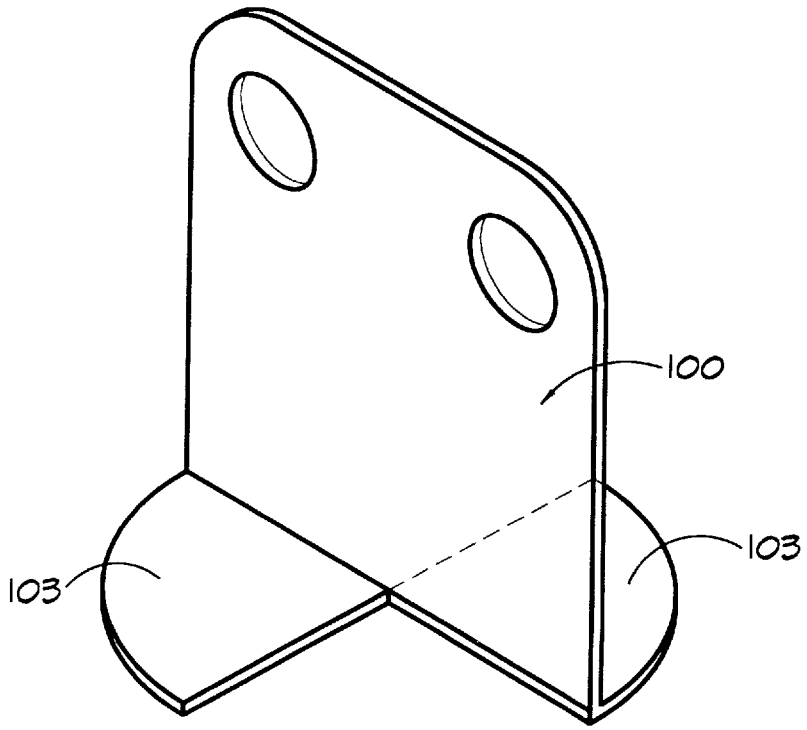
Figure 40C:
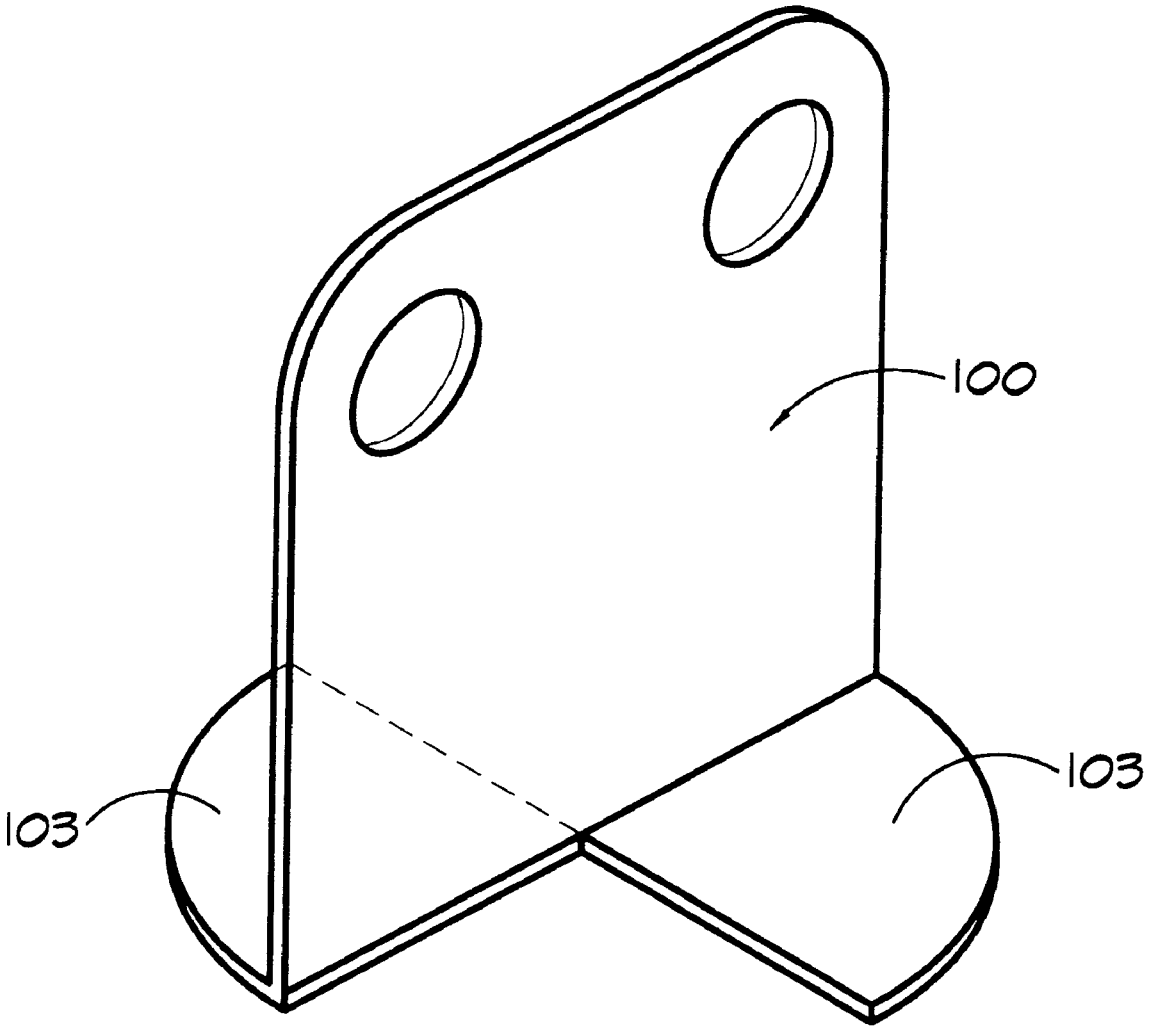

Refer now to FIG. 40 which shows an embodiment of a mid-span floor mount 77, The mid-span floor latch 97 is the same as the mid-span floor mount 77 except the latch span 98 has latch cut-outs 99. The latch cut-outs 99 fit over latch tabs 94 on the base hook latch 92 or over the latch top 91 on the hook latch 88. The mid-span floor latch 97 is then rotated 90° and pipe 57 is inserted through the pipe holes 81 preventing twisting off. The mid-span floor latch is securely locked to the floor. The latch cut-outs 99 can also be put onto the wall span 73 of a mid-span wall mount 72.

FIG. 41

Figure 41A:
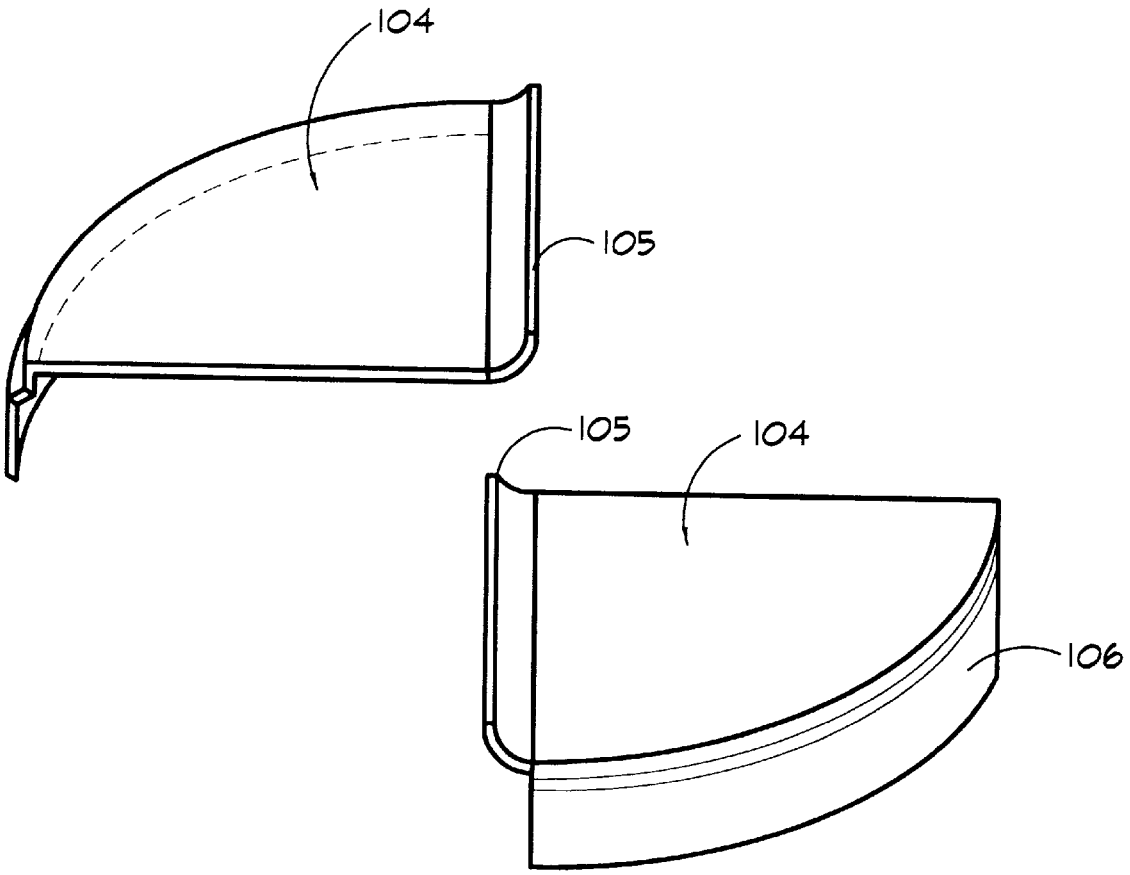
FIG. 41 shows a flat pattern layout of a twist mount.
Figure 41B:
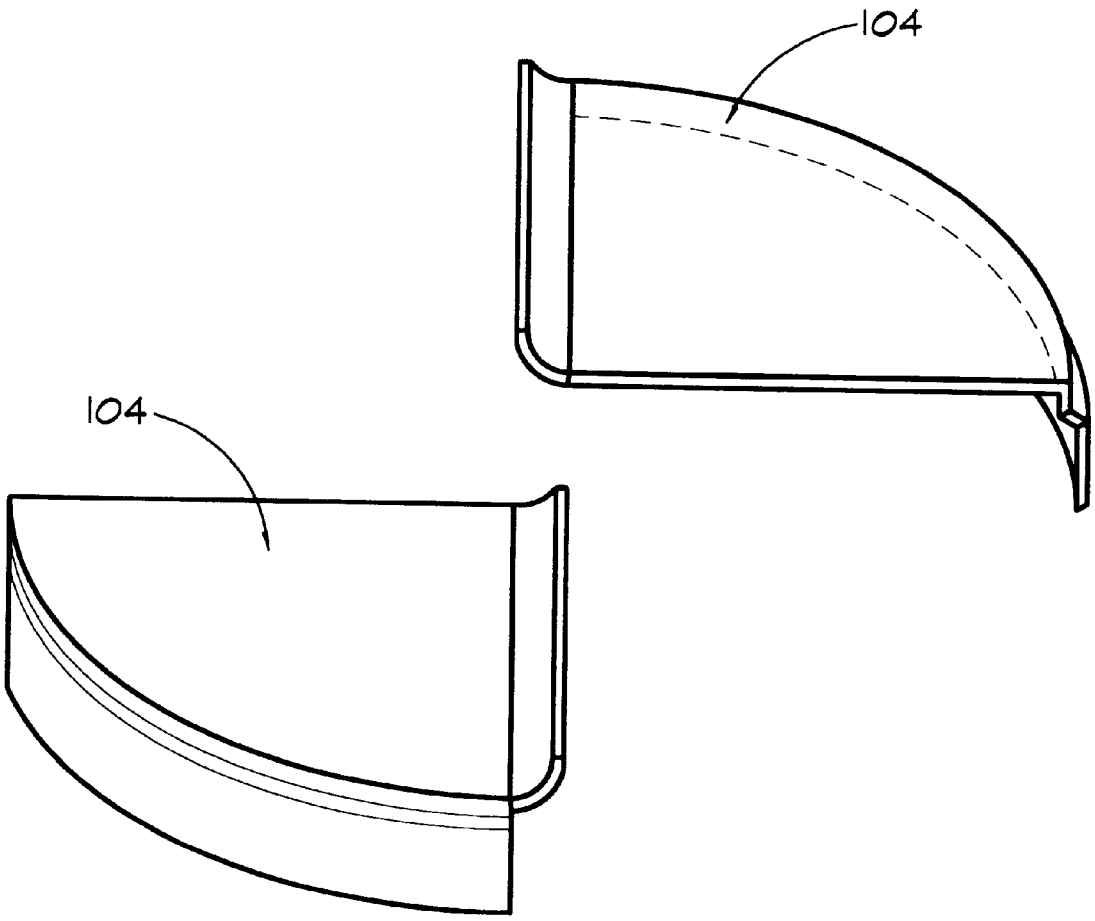
Figure 42A:
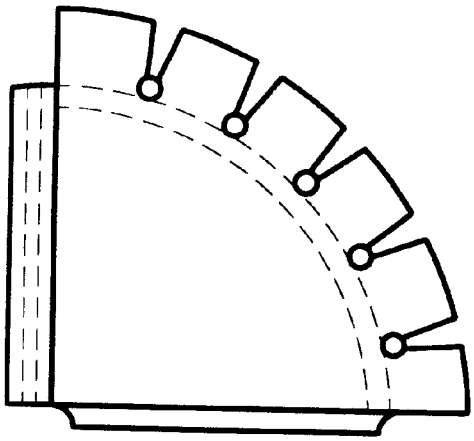
Figure 42B:
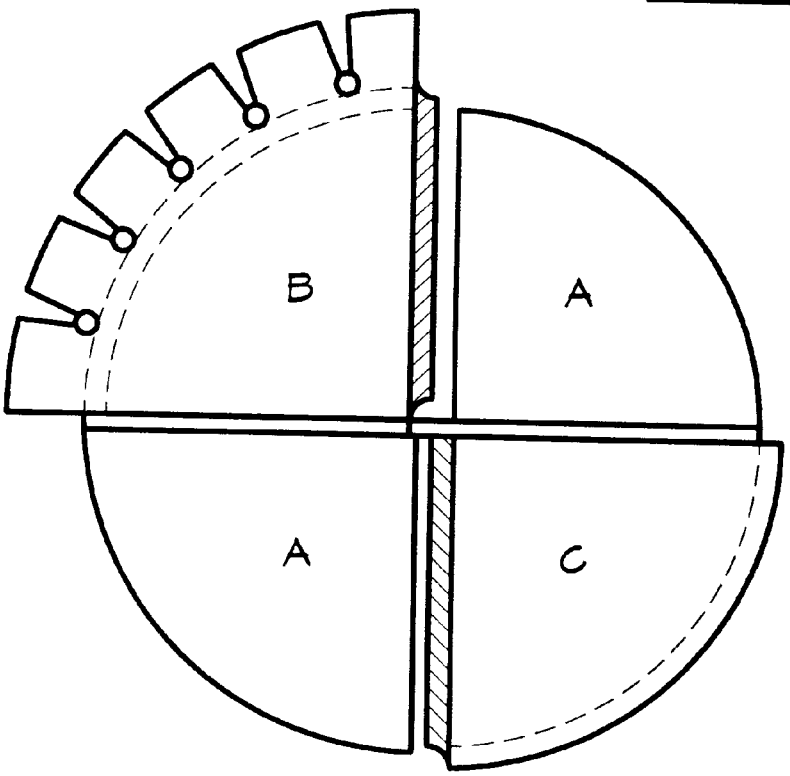

FIG. 41 shows an embodiment of a floor mount. FIG. 41 shows a flat pattern layout of a twist mount 100 with twist bend 101 and pipe holes 102. The use and operation of pipe holes 102 have been discussed previously. The twist bend 101 can be bent in two directions.

FIGS. 42, 42A–D

FIGS. 42A–D show bending the wing tabs 103 in different directions forms a twist mount 100 that can be mounted 90° in different directions using twist docks 104.

FIGS. 43A-B

Figure 43A:
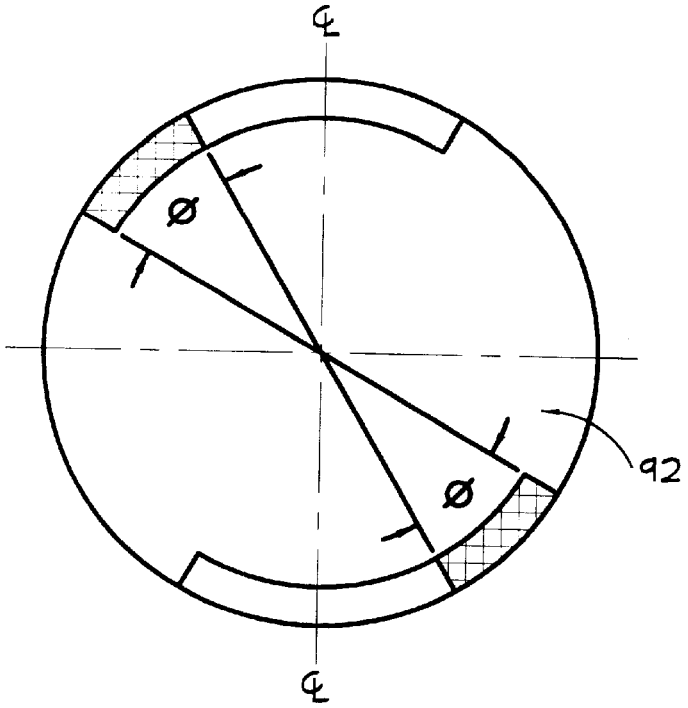
FIGS. 43A-B show twist docks with a circle dock.
Figure 43B:
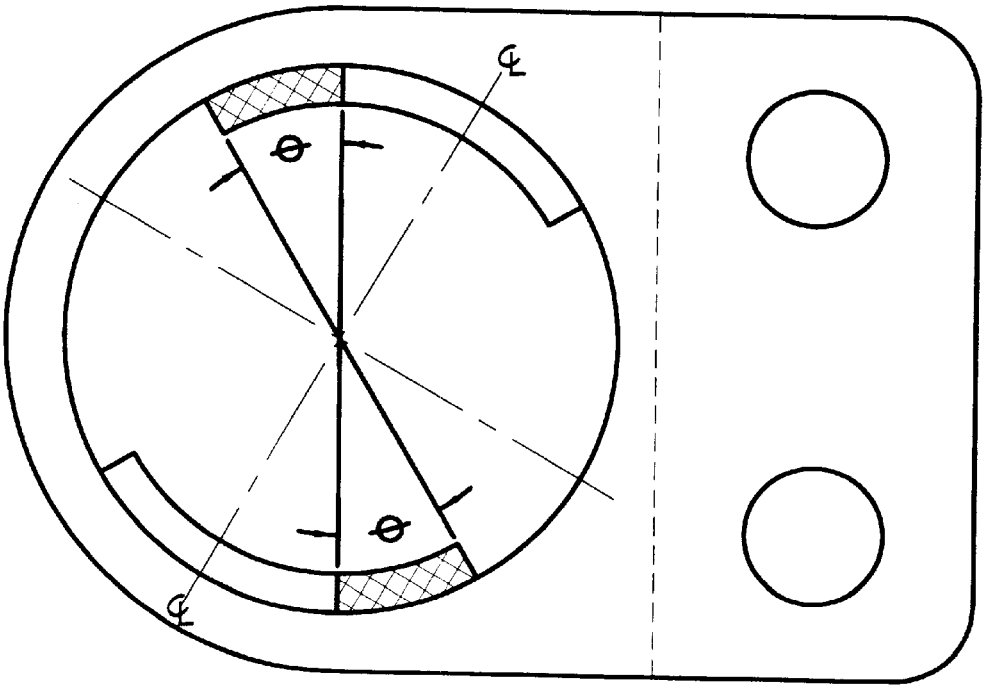
Figure 43C:
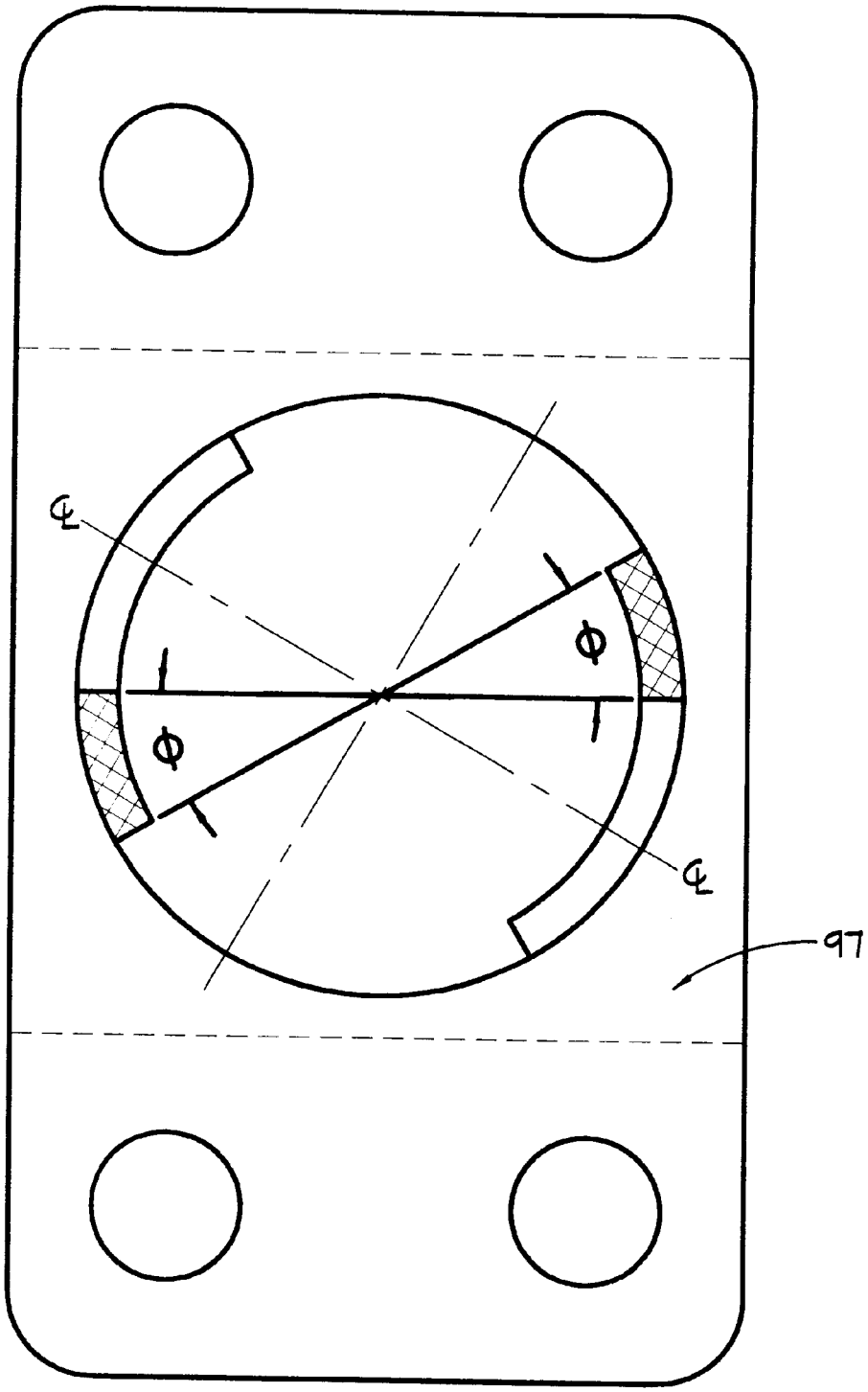
Figure 45A:
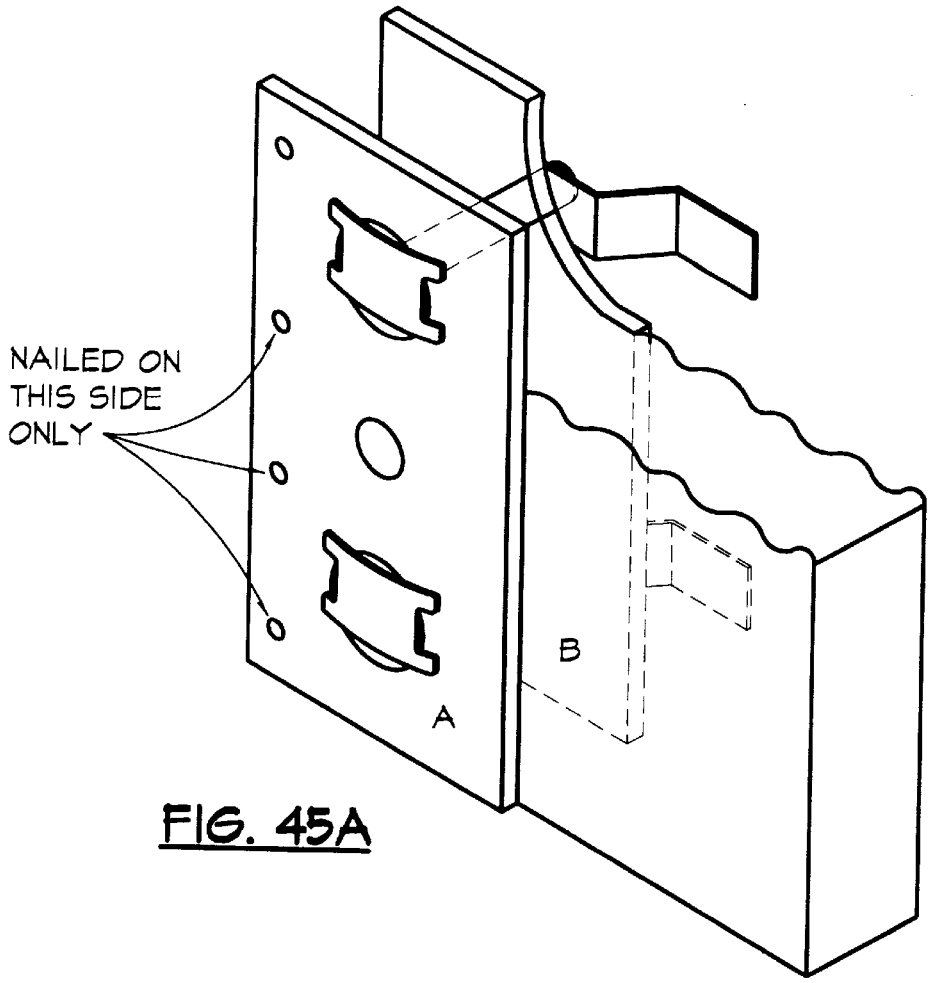
Figure 45B:
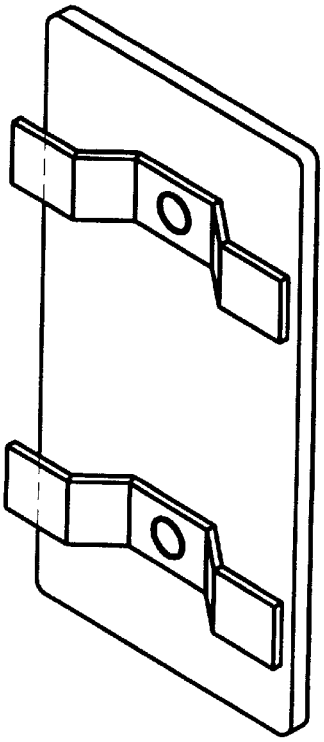
Figure 45C:
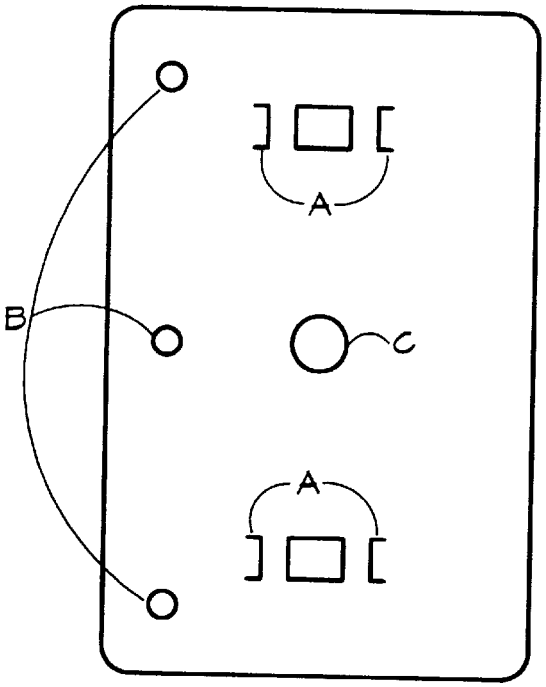
Figure 45D:
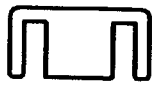
Figure 45E:
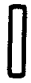
Figure 45F:
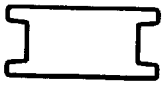
Figure 45G:
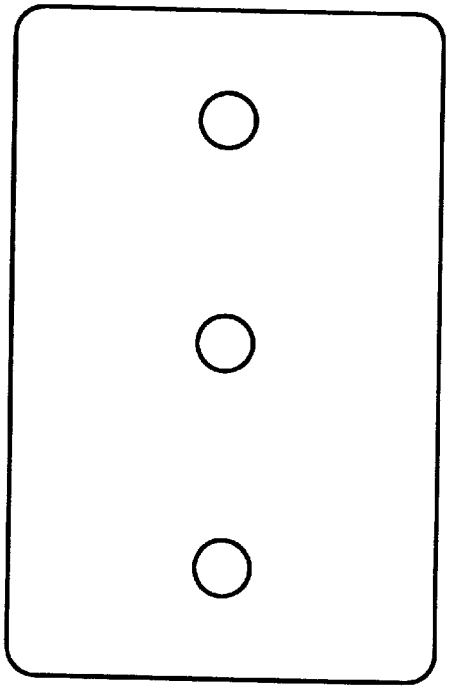

FIGS. 43A-B show twist docks 104 with a circle dock 106 that has the same diameter as a core drill circle described previously. The core drill drills a core circle and epoxy and two twist docks 104 are inserted into the epoxy with the circle dock 106 in the epoxy. FIGS B and C show how they could be set into the epoxy. They will not be noticed. When a hurricane comes, the twist mounts 100 can be inserted into the twist docks 104 and rotated 90°. Pipes 57 through the pipe holes 102 will prevent twisting and pullout. They could be mounted on a masonry wall with the location of the pipe holes 102 changed slightly. Operation is the same as other pipe-using brackets.

FIG. 44-45

Refer now to FIGS. 44-45 which show how the flat pattern layout looks before cutting and bending and after cutting and bending.

FIGS. 46–48

Figure 46A:
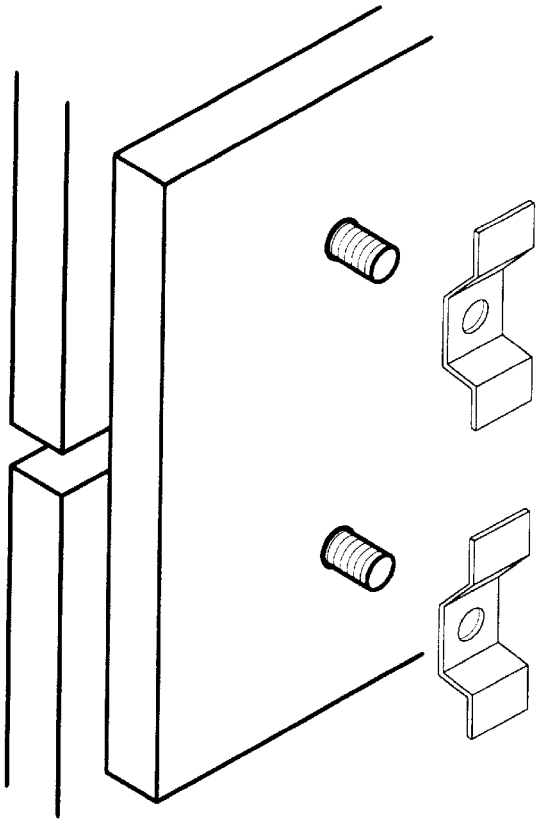
FIGS. 46 and 47 show the locking angles for a base hook latch and mid-span floor latch.
Figure 46B:
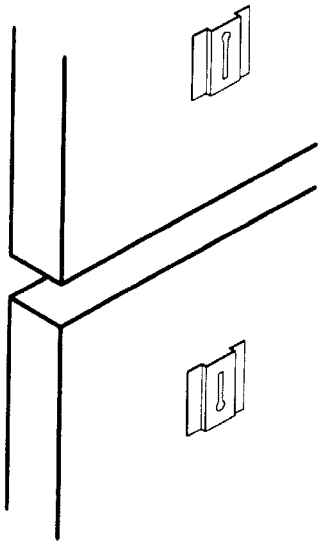
Figure 46C:
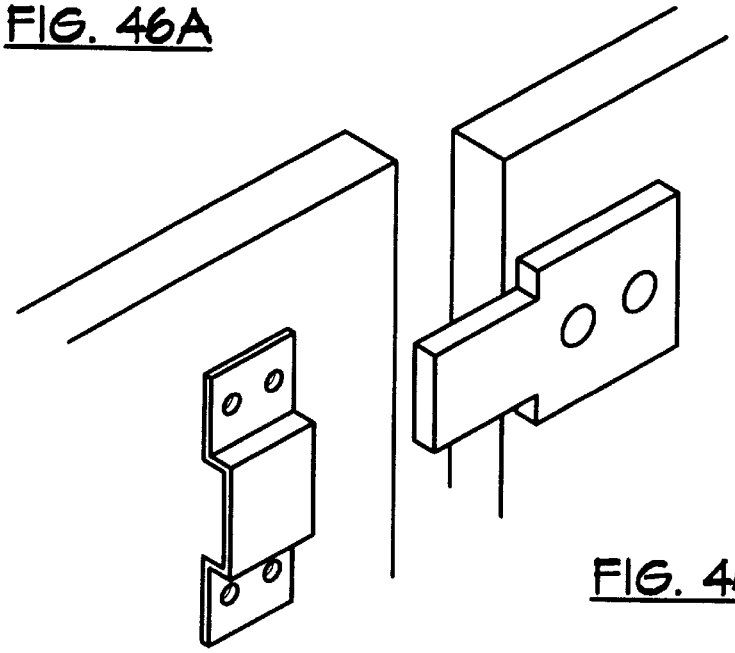
Figure 47A:
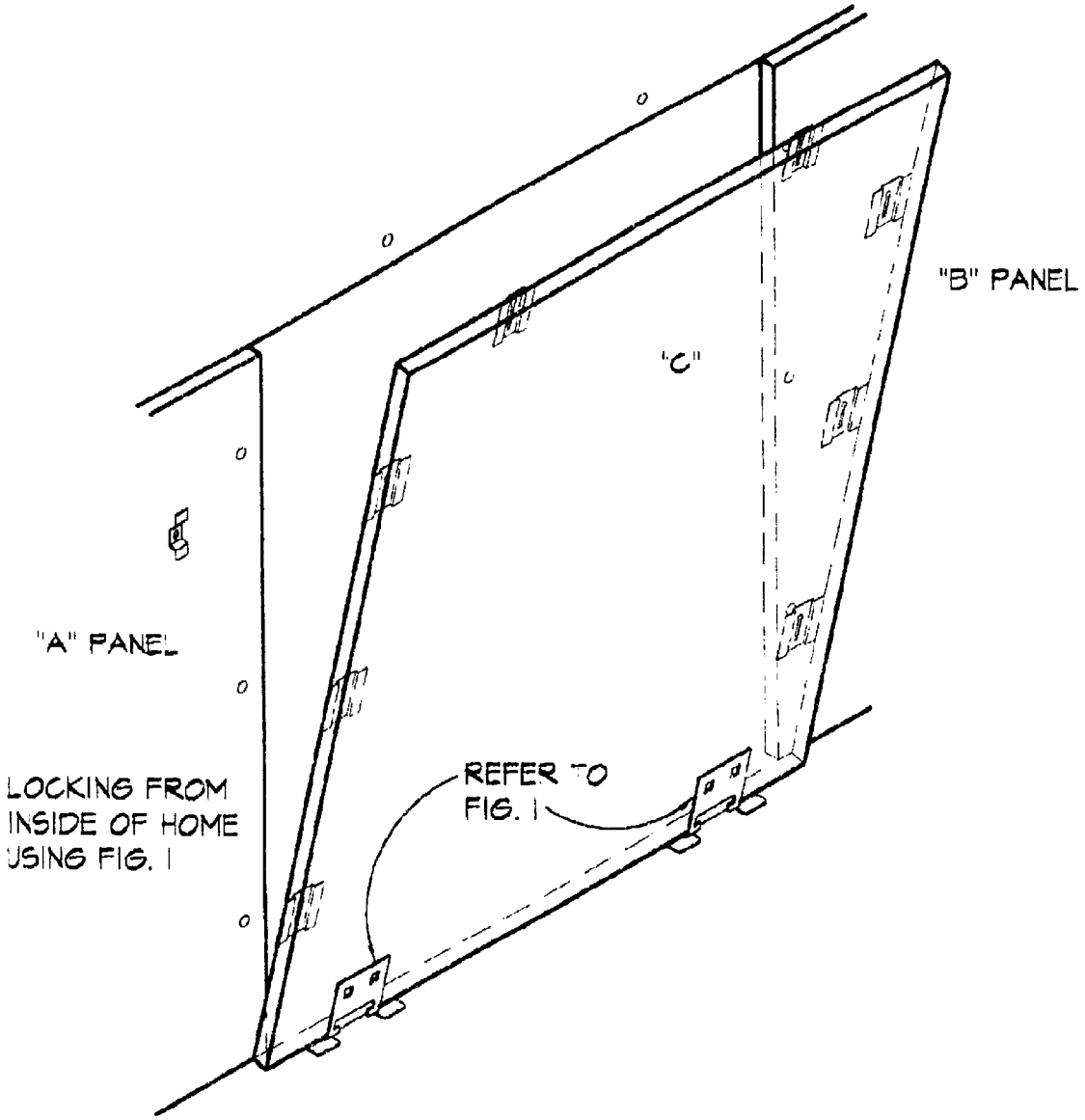
Figure 47B:
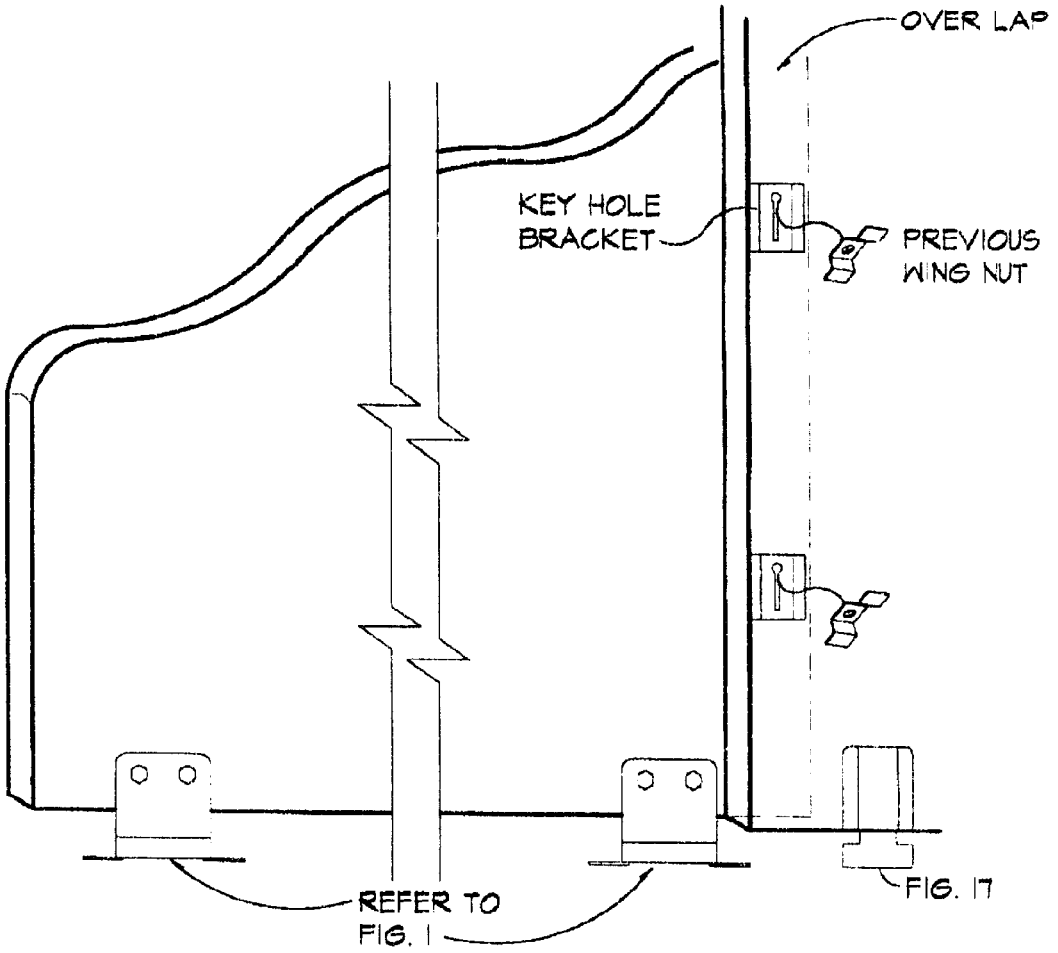
Figure 47C:
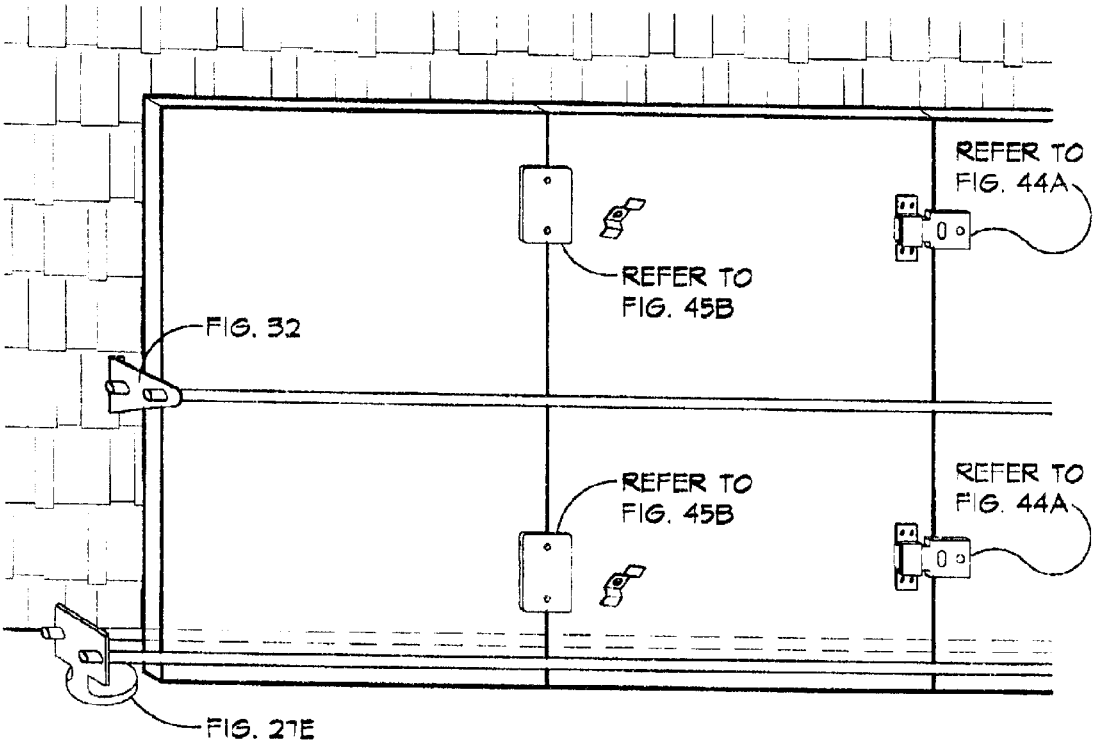

Refer now to FIGS. 46–48 which show the locking angles for a base hook latch 92 and mid-span floor latch 97. FIG. 48 shows a single mid-span floor latch 107. The pipe holes could be moved for use as a wall mount.

CONCLUSION, RAMIFICATIONS, AND SCOPE OF INVENTION

Accordingly, the reader will see that the hurricane shutter hardware of the invention are simple, strong, inexpensive, and easy to install. The invention provides a means of quickly attaching a large covering over a vast window or door that can withstand wind, wind-driven missiles, and heavy rain.

To prevent hurricane damage, engineers have maintained that the roof must be held down and wind and rain must be prevented from entering a house. In the future, building codes may require new houses built in hurricane-prone areas to have shutters that will keep out wind-driven rain and debris. This invention provides a low-cost, easy to install and remove, safe and reliable means of protecting large windows and doors. This invention can be retro-fit onto new and older homes built of wood or masonry.

This invention concerns the hardware for attaching a covering over a large window or door. Brackets are permanently attached to the wall or floor framing a large window or door. Locking brackets are permanently attached to the window shutter which can be made of almost any strong material.

The homeowner supplies the covering material that is contiguous to his or her area. The covering material can be made of plywood, bamboo, aluminum, steel, acrylic sheet, kevlar or other lightweight and strong material that may be invented in the future. The shutters can be made from recycled steel, aluminum, or car tires. Shutters can have more than one use. As long as the homeowner can lift the shutter material, almost any thickness of material can be accommodated. The thinner and stronger the material, the more security and ease of storing the shutters for future use.

The shutters can be stored in a basement, crawlspace, garage, or shed. As photovoltaic's decrease in price, they could be attached to the inside part of the window shutters, and be attached to the roof, supplying electricity to the house. When a hurricane is eminent, the homeowner removes the panels from the roof, and turns them so the photovoltaic's are on the inside of the window, giving the shutters two important uses.

The shutters can be made from two or more materials. They could have thin steel on the inside, with a rubberized coating on the outside to absorb and dampen shocks from wind-borne missiles. Or it could have lightweight aluminum on the inside, with neoprene on the outside. The shutter could have lightweight honeycomb structures on the inside to provide strength, and a thin coating of metal on the inside part, facing the window, and neoprene on the outside. Plywood was used in the past, because it was plentiful and cheap. New recycling and reusing of materials may make these shutters very economically and environmentally attractive to homeowners and government agencies.

I claim:

1. Heavy duty mount for holding a large shutter in front of a window or door as a means for protection from hurricane forces, comprising:

a floor mount for attaching to a floor of a house structure;

a bayonet web centrally located on a base portion of said floor mount, wherein said bayonet web being T-shaped and bent at a right angle to said base portion forming a tab;

a J-bracket attached to a shutter cover; and a T-shaped cut-out on said J-bracket to receive said bayonet web, wherein said cut-out is lain on top of said bayonet web at an angle and rotated to lock J-bracket to floor mount when said J-bracket is attached to floor mount.

2. The heavy duty mount of claim 1, wherein an upper portion of said J-bracket having a plurality of bolt holes to attach said J-bracket to said shutter.

3. The heavy duty mount of claim 2, wherein said base portion of said floor mount when mounted is flat against said floor; and said base portion having a plurality of bolt holes to attach said floor mount to said floor.

4. The heavy duty mount of claim 2, wherein said base portion of said floor mount is cylindrical to attach said floor mount to a concrete floor.

5. The heavy duty mount of claim 4, wherein said bayonet web is on an upper circular portion of said floor mount and a lower cylindrical portion of said floor mount is to be epoxied into said concrete floor.

6. The heavy duty mount of claim 5, wherein said lower cylindrical portion of said floor mount having radius notches and stress relievers preventing said upper circular portion of said floor mount from distorting.

7. The heavy duty mount of claim 2, said base portion of said floor mount further comprising a swan mount and a duck mount.

8. The heavy duty mount of claim 7, wherein said duck mount is semi-cylindrical attaching said floor mount to a concrete floor; said mound having a semi-cylindrical portion, a flat, open portion and a vertical member rising above one side of an upper semi-circular portion of said duck mount.

9. The heavy duty mount of claim 8, wherein said semi-cylindrical portion of said duck mount having radius notches and stress relievers preventing said upper circular portion of said duck mount from distorting.

10. The heavy duty mount of claim 8, wherein said swan mount is semi-cylindrical with a semi-cylindrical portion, a flat, open side and a vertical member rising above said open side of an upper semi-circular portion of said swan mount.

11. The heavy duty mount of claim 10, wherein top of said vertical member of said swan mount further comprises a sharp, overlapping bend mating to said vertical member of said duck mount.

12. The heavy duty mount of claim 11, wherein said bayonet web is on said upper semi-circular portion of said swan mount and semi-cylindrical portion of said swan mount and semi-cylindrical portion of said duck mount are to be epoxied into a concrete floor.

13. The heavy duty mount of claim 12, wherein said semi-cylinder portion of said swan mount having radius notches and stress relievers preventing said upper circular portion of said swan mount from distorting.

14. The heavy duty mount of claim 10, wherein said bayonet web is on said upper semi-circular portion of said swan mount and wherein semi-cylindrical portion of said swan mount and semi-cylindrical portion of said duck mount are to be expoxied into a concrete floor.

15. The heavy duty mount of claim 10, wherein said semi-cylinder portion of said swan mount having radius notches and stress relievers preventing said upper circular portion of said swan mount from distorting.

* * * * *